US011529664B2

(12) United States Patent
Kohno

(10) Patent No.: US 11,529,664 B2
(45) Date of Patent: Dec. 20, 2022

(54) PRESS SYSTEM

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 796 days.

(21) Appl. No.: 16/250,334

(22) Filed: Jan. 17, 2019

(65) Prior Publication Data

US 2019/0232353 A1 Aug. 1, 2019

(30) Foreign Application Priority Data

Jan. 31, 2018 (JP) ..... JP2018-015454

(51) Int. Cl.
*B21D 24/02* (2006.01)
*B21D 24/14* (2006.01)
(Continued)

(52) U.S. Cl.
CPC ..... *B21D 24/02* (2013.01); *B21D 24/14* (2013.01); *B30B 1/265* (2013.01); *B30B 15/16* (2013.01); *B30B 15/22* (2013.01)

(58) Field of Classification Search
CPC ..... B21D 24/02; B21D 24/14; B21D 24/00; B21D 24/10; B30B 1/265; B30B 15/16;
(Continued)

(56) References Cited

U.S. PATENT DOCUMENTS 2,300,162 A 10/1942 Maude
5,499,525 A 3/1996 Kordak et al.
(Continued)

FOREIGN PATENT DOCUMENTS

CN 1796105 A 7/2006
CN 101835601 A 9/2010
(Continued)

OTHER PUBLICATIONS

Notification of Reasons for Refusal issued in corresponding Japanese Application No. 2018-015454, dated Dec. 18, 2019, with English translation.
(Continued)

*Primary Examiner* — Shelley M Self
*Assistant Examiner* — Teresa A Guthrie
(74) *Attorney, Agent, or Firm* — McDermott Will & Emery LLP

(57) ABSTRACT

A press system providing excellent energy efficiency for a whole press system and capable of achieving low prices is provided. A die cushion apparatus constituting a press system supports a cushion pad, includes a hydraulic cylinder which generates a die cushion load on the cushion pad when a slide of a press machine descends, the press machine includes a hydraulic cylinder which generates part of a press load on the slide when the slide descends. The pressure generation chamber of the hydraulic cylinder for generating a die cushion load and the pressure generation chamber of the hydraulic cylinder for generating part of the press load can communicate with each other via pipes and a first logic valve for a period during which the die cushion load acts.

13 Claims, 22 Drawing Sheets

(51) Int. Cl.

| | |
|---|---|
| ***B30B 1/26*** | (2006.01) |
| ***B30B 15/16*** | (2006.01) |
| ***B30B 15/22*** | (2006.01) |

(58) Field of Classification Search
CPC ..... B30B 15/22; B30B 15/061; B30B 15/18; B30B 15/183; B30B 15/186
USPC ..... 100/269.01
See application file for complete search history.

(56) References Cited

U.S. PATENT DOCUMENTS

| | | | | |
|---|---|---|---|---|
| 5,794,482 | A * | 8/1998 | Walkin | B21D 24/14 72/350 |
| 2003/0226633 | A1 | 12/2003 | Muramoto et al. | |
| 2009/0071218 | A1 | 3/2009 | Kohno et al. | |
| 2010/0212521 | A1 | 8/2010 | Resch et al. | |
| 2011/0226141 | A1 | 9/2011 | Kohno | |
| 2017/0008061 | A1* | 1/2017 | Kohno | B21D 24/02 |
| 2017/0312810 | A1 | 11/2017 | Kuwano et al. | |

FOREIGN PATENT DOCUMENTS

| | | | |
|---|---|---|---|
| CN | 205446226 | U | 8/2016 |
| CN | 106334743 | A | 1/2017 |
| CN | 106739122 | A | 5/2017 |
| CN | 107000030 | A | 8/2017 |
| DE | 3040297 | A1 | 6/1982 |
| DE | 4309641 | A1 | 9/1993 |
| EP | 2077167 | A2 | 7/2009 |
| JP | 2006-315074 | A | 11/2006 |
| JP | 2010-069498 | A | 4/2010 |
| JP | 2017-018988 | A | 1/2017 |
| WO | 2010/058710 | A1 | 5/2010 |

OTHER PUBLICATIONS

Extended European Search Report issued in corresponding European Patent Application No. 19154430.3, dated Jul. 12, 2019.
Chinese Office Action issued in corresponding Chinese Patent Application No. 201910102898,6, dated Nov. 23, 2021, with English translation.
Chinese Office Action dated Aug. 1, 2022 in the corresponding Chinese Patent Application No. 201910102898.6, with English translation.

* cited by examiner

FIG.20

| | MOTOR CAPACITY OF WHOLE PRESS SYSTEM | AVERAGE POWER DURING FORMING | POWER SUPPLY CAPACITY |
|---|---|---|---|
| PRIOR ART 1 | 3 | 1.3 | 3 |
| PRIOR ART 2 | 3 | 1.15 | 1.15 |
| PRIOR ART 3 | 2.5 | 1.65 | 2.5 |
| PRESENT INVENTION | 1.2 | 1.1 | 1.2 |

PRESS SYSTEM

CROSS-REFERENCE TO RELATED APPLICATIONS

The present application claims priority under 35 U.S.C. § 119 to Japanese Patent Application No. 2018-015454, filed on Jan. 31, 2018. The above application is hereby expressly incorporated by reference, in its entirety, into the present application.

BACKGROUND OF THE INVENTION

Field of the Invention

The present invention relates to a press system, and more particularly, to a technique for reducing cost of a whole press system.

Description of the Related Art

Press machines (so-called "servo presses") driven by a servo motor are becoming widespread in the market in recent years. The servo press includes a servo motor which has a (relatively) large capacity proportional to the power conforming to press forming at any time. This increases a price, a size of a control panel and a power receiving capacity.

In addition, in a case where a die cushion apparatus for drawing is mounted on a servo press, the die cushion apparatus (servo die cushion) needs to be driven by a servo motor in the same manner as (or in accordance with) the servo press. This type of die cushion apparatus includes a servo motor which has a capacity close to the power corresponding to press forming at any time. For example, the servo motor has a capacity which is about ½ (to ⅔) of the power corresponding to press forming at any time.

This further increases the price, the power receiving capacity and the size of the control panel of the press system (press system including the die cushion apparatus and the press machine) driven by the servo motor.

FIG. 21 illustrates an example of a press system driven by a conventional servo motor.

A press system 1 shown in FIG. 21 includes a hydraulic-drive-type press machine 1-1 and a die cushion apparatus 1-2 described in Japanese Patent Application Laid-Open No. 2006-315074 (PTL 1). In the press machine 1-1, each of hydraulic pumps/motors 105-1 to 105-4 is shaft-connected to each of four servo motors 106-1 to 106-4. Both ports (hydraulic connection ports) of the hydraulic pumps/motors 105-1 to 105-4 are connected to a rod-side hydraulic chamber 117*a* and a head-side hydraulic chamber (hereinafter, referred to as "pressure generation chamber") 117*b* of a hydraulic cylinder 117. A slide 110 is driven in the vertical direction by the hydraulic cylinder 117 in the press machine 1-1.

In the die cushion apparatus 1-2, each of hydraulic pumps/motors 140-1 and 140-2 is shaft-connected to each of two servo motors 141-1 and 141-2. Both ports (hydraulic connection ports) of the hydraulic pumps/motors 140-1 and 140-2 are connected to a rod-side hydraulic chamber 130*a* and a head-side hydraulic chamber (hereinafter, referred to as "pressure generation chamber") 130*b* of a hydraulic cylinder 130. The hydraulic pumps/motors 140-1 and 140-2 are driven by the servo motors 141-1 and 141-2 respectively to generate a die cushion force in a cushion pad 128 (blank holder 124 connected to the cushion pad 128 via cushion pins 126) via the hydraulic cylinder 130.

That is, when the slide 110 driven by the press machine 1-1 descends, the force transmitted from the slide 110 to the hydraulic cylinder 130 via the cushion pad 128 compresses the pressure generation chamber 130*b* of the hydraulic cylinder 130 and generates the die cushion pressure.

The hydraulic pumps/motors 140-1 and 140-2 of the die cushion apparatus 1-2 can function as hydraulic motors with pressure oil displaced (pushed away) from the pressure generation chamber 130*b* of the hydraulic cylinder 130. While the rotary shaft torque generated at the hydraulic pumps/motors 140-1 and 140-2 resists against the drive torque of the servo motors 141-1 and 141-2, this die cushion apparatus 1-2 causes the servo motors 141-1 and 141-2 to rotate and controls the die cushion pressure (die cushion force).

Furthermore, the die cushion apparatus 1-2 described in Japanese Patent Application Laid-Open No. 2006-315074 regenerates the energy used for die cushion operation received by the cushion pad 128 during the die cushion is applied, as electric energy via the hydraulic cylinder 130, the hydraulic pumps/motors 140-1 and 140-2 functioning as hydraulic motors and the servo motors 141-1 and 141-2 functioning as power generators. The die cushion apparatus can regenerate approximately 70% of the work load (work done) accompanying the application of the die cushion load, as a power supply, and thus, the die cushion apparatus is excellent in energy efficiency. In FIG. 21, reference numerals 113, 114, 118, and 119 indicate check valves, and reference numerals 116 and 164 indicate linear motion type relief valves respectively.

FIG. 22 illustrates another example of the press system driven by a conventional servo motor.

The press system 2 shown in FIG. 22 includes a machine-drive-type (crank-drive-type) press machine 2-1 and the die cushion apparatus 1-2 described in Japanese Patent Application Laid-Open No. 2006-315074. In the press machine 2-1, the slide 110 is driven in the vertical direction using four servo motors 106-1 to 160-4 via a crank shaft 112 and a connecting rod 103.

Furthermore, in a press system described in Japanese Patent Application Laid-Open No. 2010-069498 (PTL 2), an energy storage device is connected to a slide circuit connecting a slide DC (direct current) power supply circuit forming a slide motor drive device and a slide driver circuit. In addition, a die cushion apparatus is formed so as to be drivable by a die cushion motor drive device including a die cushion driver circuit and a die cushion motor, and the slide circuit is connected to the die cushion driver circuit via an energy supply device. Thereby, the press system described in Japanese Patent Application Laid-Open No. 2010-069498 (PTL 2) can supply the energy stored in the energy storage device via the energy supply device as drive energy for a die cushion motor and supply regenerative energy of the die cushion motor as slide motor drive energy.

Furthermore, a die cushion apparatus described in WO2010-058710 (PTL 3) is intended to reduce the number of servo motors in the die cushion apparatus described in Japanese Patent Application Laid-Open No. 2006-315074. In the die cushion apparatus described in WO2010-058710, a proportional valve and hydraulic pump/motor are connected in parallel between a pressure generation chamber of a hydraulic cylinder which generates a die cushion pressure and a low-pressure source respectively. Thereby, the die cushion apparatus described in WO2010-058710 is configured to control an opening of the proportional valve and torque of a servo motor which drives the hydraulic pump/motor such that a pressure of the pressure generation chamber of the hydraulic cylinder when a cushion pressure is generated becomes a pressure corresponding to a die cushion pressure command.

PATENT LITERATURES

PTL 1: Japanese Patent Application Laid-Open No. 2006-315074

PTL 2: Japanese Patent Application Laid-Open No. 2010-069498

PTL 3: International Publication No. WO2010-058710

SUMMARY OF INVENTION

The die cushion apparatus shown in Japanese Patent Application Laid-Open No. 2006-315074 (die cushion apparatus 1-2 shown in FIG. 21 and FIG. 22) can regenerate approximately 70% of the work load accompanying the application of the die cushion load, as the power supply, and has excellent energy efficiency as described above. However, the necessary servo motor capacity and the power supply capacity need to provide the power accompanying the application of the die cushion load.

Furthermore, in the conventional press system 1 shown in FIG. 21, the main drive mechanism (hydraulic cylinder 117, the servo motors 106-1 to 106-4, the hydraulic pumps/motors 105-1 to 105-4 or the like) used for press drive (slide drive) is completely separated from the main drive mechanism (the hydraulic cylinder 130, the servo motors 141-1 and 141-2, the hydraulic pumps/motors 140-1 and 140-2 or the like) used for die cushion drive (cushion pad drive).

Similarly, in the conventional press system 2 shown in FIG. 22, the press (slide) drive main drive mechanism (servo motors 106-1 to 106-4, the crank shaft 112 and the connecting rod 103 or the like) is completely separated from the die cushion (cushion pad) drive main drive mechanism (hydraulic cylinder 130, the servo motors 141-1 and 141-2, the hydraulic pumps/motors 140-1 and 140-2 or the like).

Therefore, the servo motor capacity, power supply capacity or power of the whole systems of the press systems 1 and 2 shown in FIG. 21 and FIG. 22 correspond to the sum total with the press machine 1-1 or 2-1 and the die cushion apparatus 1-2. This causes increase in the motor capacity or the like of the whole press system. Note that Japanese Patent Application Laid-Open No. 2006-315074 includes no description regarding the servo motor capacity, power supply capacity thereof or power of the press machine.

In the press system described in Japanese Patent Application Laid-Open No. 2010-069498, the driver circuit for the press machine driven by a servo motor and the driver circuits for the die cushion apparatus driven by a servo motor separate from the servo motor share a DC power supply circuit including the energy storage devices. Therefore, it is possible to reduce the sizes of the (AC (alternative current) and DC) power supply apparatuses and improve the energy efficiency, whereas the necessary servo motor capacity and the driver capacity thereof still need to provide the power accompanying the application of the press load and the application of the die cushion load.

Furthermore, the die cushion apparatus described in WO2010-058710 can reduce the servo motor capacity to approximately half or less, but it has a problem that the energy efficiency reduces correspondingly due to pressure loss in the proportional valve. Note that WO2010-058710 has no description regarding the servo motor capacity or power supply capacity or power of the press machine.

The present invention has been implemented in view of such circumstances, and aims to provide a press system which has excellent energy efficiency of the whole press system with low costs.

In order to attain the above described object, an invention according to an aspect is a press system includes a die cushion apparatus and a press machine, in which the die cushion apparatus includes a first hydraulic cylinder configured to support a cushion pad and apply a die cushion load to the cushion pad when a slide of the press machine descends, the press machine includes a second hydraulic cylinder configured to apply a part of a press load to the slide when the slide descends, and the press system includes: a piping configured to connect between a first pressure generation chamber which is provided to the first hydraulic cylinder and configured to generate the die cushion load, and a second pressure generation chamber which is provided to the second hydraulic cylinder and configured to generate the part of the press load; and a valve configured to allow the piping to establish the communication between the first pressure generation chamber and the second pressure generation chamber for a period during which the die cushion load acts on the first hydraulic cylinder.

According to the above aspect of the present invention, the die cushion load generated in the first hydraulic cylinder when the slide descends can cancel the die cushion load (acting load) out of the press load applied to the slide when the slide descends, and only the forming load of the press load except the die cushion load can be made to act on the slide separately. It is thereby possible to achieve cost reduction and excellent energy efficiency of the whole press system.

In a press system according to another aspect of the present invention, when a pressure receiving area of the first pressure generation chamber of the first hydraulic cylinder is S1 and a pressure receiving area of the second pressure generation chamber of the second hydraulic cylinder is S2, the S2 is preferably 0.95×S1 or more and 1.05×S1 or less.

In a press system according to a further aspect of the present invention, the press machine is provided with a third hydraulic cylinder configured to generate a residual press load except a press load of the part of the press load on the slide when the slide descends. Since an upward die cushion load acting from the first hydraulic cylinder cancel a downward press load acting from the second hydraulic cylinder, a press load applied by the third hydraulic cylinder to the slide corresponds to a forming load for press-forming a material.

In a press system according to a still further aspect of the present invention, the press machine preferably includes a plurality of the third hydraulic cylinders, and the plurality of third hydraulic cylinders are provided in parallel to the slide. This makes it possible to apply uniform press load to the slide.

In a press system according to a still further aspect of the present invention, the press machine is provided with a mechanical drive unit configured to mechanically apply a residual press load except the part of the press load to the slide when the slide descends. The press load applied to the slide by the mechanical drive unit corresponds to the forming load which press-forms a material.

In a press system according to a still further aspect of the present invention, the mechanical drive unit is preferably provided with a crank shaft, a connecting rod configured to connect the crank shaft and the slide, and a crank shaft drive unit configured to drive the crank shaft.

In a press system according to a still further aspect of the present invention, it is preferable that the die cushion apparatus includes a plurality of the first hydraulic cylinders, the plurality of first hydraulic cylinders are provided in parallel, and the first pressure generation chambers of the plurality of first hydraulic cylinders are caused to communicate with each other. Thereby, the plurality of first hydraulic cylinders can apply the die cushion load to the cushion pad uniformly.

In a press system according to a still further aspect of the present invention, it is preferable that the press machine comprises a plurality of the second hydraulic cylinders, the plurality of second hydraulic cylinders are provided in parallel, and the second pressure generation chambers of the plurality of second hydraulic cylinders are caused to communicate with each other. This makes it possible to dispose the plurality of second hydraulic cylinders at positions corresponding to the plurality of first hydraulic cylinders or dispose the second hydraulic cylinders dispersively for the sake of convenience in arrangement so as not to interfere with arrangements of other mechanisms.

In a press system according to a still further aspect of the present invention, it is preferable that the valve is a pilot-drive-type first logic valve, and the press system includes: a first solenoid valve configured to switch a pressure acting on a pilot port of the first logic valve between a pressure of the first pressure generation chamber of the first hydraulic cylinder and a system pressure which is a pressure of a low-pressure source; and a valve controller configured to switch the first solenoid valve at least for a period during which the die cushion load acts on the first hydraulic cylinder, and cause the pressure of the low-pressure source to act on the pilot port of the first logic valve to open the first logic valve.

The pilot-drive-type first logic valve is opened when a low-pressure system pressure acts on the pilot port in accordance with the switching by the first solenoid valve so as to establish communication of a pipe connecting the first pressure generation chamber of the first hydraulic cylinder and the second pressure generation chamber of the second hydraulic cylinder. Thus, the press system can make the first hydraulic cylinder generate a die cushion load (acting portion), which is a part of the press load applied to the second hydraulic cylinder when the slide descends, applied to the slide via the pipe. That is, it is possible to make the first pressure generation chamber of the first hydraulic cylinder have the same pressure as the pressure of the second pressure generation chamber of the second hydraulic cylinder.

In a press system according to a still further aspect of the present invention, the press system further includes: a pilot-drive-type second logic valve configured to block or establish communication between the second pressure generation chamber of the second hydraulic cylinder and the low-pressure source; and a second solenoid valve configured to switch the pressure acting on the pilot port of the second logic valve between the pressure of the second pressure generation chamber of the second hydraulic cylinder and the system pressure which is the pressure of the low-pressure source, wherein, for a period before the die cushion load acts on at least the first hydraulic cylinder and the slide descends, the valve controller switches the second solenoid valve and causes the pressure of the second pressure generation chamber to act on the pilot port of the second logic valve to open the second logic valve, and switches the first solenoid valve and causes the pressure of the first pressure generation chamber to act on the pilot port of the first logic valve to close the first logic valve.

By opening the pilot-drive-type second logic valve, it is possible to supply a hydraulic liquid from the low-pressure source to the second pressure generation chamber of the second hydraulic cylinder when the slide descends. In addition, by closing the first logic valve, it is possible to control the pressure of the first pressure generation chamber of the first hydraulic cylinder independently of the second pressure generation chamber.

In a press system according to a still further aspect of the present invention, in a knockout operation period of a product press-formed by the press machine, the valve controller switches the first solenoid valve, causes the pressure of the first pressure generation chamber higher than the system pressure to act on the pilot port of the first logic valve to close the first logic valve, switches the second solenoid valve, and causes the system pressure to act on the pilot port of the second logic valve to open the second logic valve.

By closing the first logic valve in the period of knockout operation on the product, it is possible to control the pressure of the first pressure generation chamber of the first hydraulic cylinder independently of the second pressure generation chamber of the second hydraulic cylinder. In addition, by opening the second logic valve, it is possible to collect the hydraulic liquid pushed away (displaced) from the second pressure generation chamber of the second hydraulic cylinder to the low-pressure source via the second logic valve.

In a press system according to a still further aspect of the present invention, the die cushion apparatus preferably includes: a pressure detector configured to detect a pressure of the first pressure generation chamber of the first hydraulic cylinder; a pressure adjustment mechanism configured to adjust the pressure of the first pressure generation chamber of the first hydraulic cylinder; a die cushion pressure command unit configured to output a die cushion pressure command corresponding to a predetermined die cushion load; and a die cushion controller configured to control the pressure adjustment mechanism based on the die cushion pressure command and the pressure detected by the pressure detector such that the pressure of the first pressure generation chamber becomes the pressure corresponding to the die cushion pressure command.

With the pressure of the first pressure generation chamber of the first hydraulic cylinder under control, the first hydraulic cylinder can generate a die cushion load on the cushion pad. Further, at this time, since the first pressure generation chamber of the first hydraulic cylinder communicates with the second pressure generation chamber of the second hydraulic cylinder via the pipe and the valve, the second hydraulic cylinder can apply a press load corresponding to the die cushion load to the slide.

In a press system according to a still further aspect of the present invention, the pressure adjustment mechanism preferably includes: a hydraulic pump/motor provided in parallel to the valve, and including a discharge port which is connected to the first pressure generation chamber of the first hydraulic cylinder; and a servo motor connected to a rotary shaft of the hydraulic pump/motor, and the die cushion controller preferably controls a torque of the servo motor based on the die cushion pressure command and the pressure detected by the pressure detector such that the pressure of the first pressure generation chamber becomes a pressure corresponding to the die cushion pressure command.

The discharge port of the hydraulic pump/motor is connected to the first pressure generation chamber of the first hydraulic cylinder, a torque of the rotary shaft of the hydraulic pump/motor is controlled by the servo motor and the pressure of the first pressure generation chamber (die cushion pressure) is controlled. Therefore, it is possible to control the die cushion pressure (die cushion load) with excellent followability in response to the die cushion pressure command. Furthermore, in the period during which the die cushion load acts on the first hydraulic cylinder, the volume of the hydraulic liquid pushed away from the first pressure generation chamber of the first hydraulic cylinder is substantially equal to the volume of the hydraulic liquid flowing into the second pressure generation chamber of the second hydraulic cylinder, and as a result, the servo motor needs only to rotate (work) by a slight rotation to compensate for the loss caused by leakage in the hydraulic pump/motor. This makes it possible to reduce the servo motor capacity.

In a press system according to a still further aspect of the present invention, the pressure adjustment mechanism preferably includes: a servo valve connected to the first pressure generation chamber of the first hydraulic cylinder and provided in parallel to the valve; and a high-pressure source configured to supply a hydraulic liquid having a substantially constant high pressure equal to or higher than a predetermined die cushion pressure to the servo valve, and the die cushion controller preferably controls an opening of the servo valve based on the die cushion pressure command and the pressure detected by the pressure detector such that the pressure of the first pressure generation chamber becomes a pressure corresponding to the die cushion pressure command.

By controlling the opening of the servo valve in the period during which the die cushion load acts on the first hydraulic cylinder, it is possible to control the pressure of the first pressure generation chamber of the first hydraulic cylinder. At this time, since the volume of the hydraulic liquid pushed away from the first pressure generation chamber of the first hydraulic cylinder is substantially equal to the volume of the hydraulic liquid flowing into the second pressure generation chamber of the second hydraulic cylinder, the servo valve basically does not handle liquid quantities except for a minute liquid amount. Therefore, the press system does not suffer from a disadvantageous feature of the servo valve such as decrease in energy efficiency. The press system can benefit dominantly from advantageous features of the servo valve such as excellence in accuracy and responsiveness. Thus, the press system is by no means functionally inferior to a press system using a servo motor (and a fixed capacity type hydraulic pump/motor).

In a press system according to a still further aspect of the present invention, the pressure adjustment mechanism preferably includes: a bidirectional variable capacity type hydraulic pump connected to the first pressure generation chamber of the first hydraulic cylinder and provided in parallel to the valve; and an electric motor connected to a rotary shaft of the bidirectional variable capacity type hydraulic pump, and the die cushion controller preferably controls a volume of the hydraulic liquid pushed away by the bidirectional variable capacity type hydraulic pump based on the die cushion pressure command and the pressure detected by the pressure detector such that the pressure of the first pressure generation chamber becomes a pressure corresponding to the die cushion pressure command.

It is possible to control the pressure of the first pressure generation chamber of the first hydraulic cylinder by controlling the displacement volume of the hydraulic liquid by the bidirectional variable capacity type hydraulic pump in a period during which the die cushion load acts on the first hydraulic cylinder. At this time, since the volume of the hydraulic liquid pushed away from the first pressure generation chamber of the first hydraulic cylinder is substantially equal to the volume of the hydraulic liquid flowing into the second pressure generation chamber of the second hydraulic cylinder, it is only necessary to slightly change the displacement volume of the bidirectional variable capacity type hydraulic pump in both directions, with the displacement volume centered on "0 (zero)". Therefore, the press system can achieve excellent energy efficiency.

In a press system according to a still further aspect of the present invention, it is preferable that the first hydraulic cylinder, the second hydraulic cylinder, the pipe and the valve are provided in plurality respectively, and the die cushion apparatus includes: a plurality of pressure detectors configured to detect pressures of the first pressure generation chambers of the plurality of the first hydraulic cylinders respectively; a plurality of pressure adjustment mechanisms configured to adjust pressures of the first pressure generation chambers of the plurality of the first hydraulic cylinders respectively, a die cushion pressure command unit configured to output a die cushion pressure command corresponding to a predetermined die cushion load, and a die cushion controller configured to control the plurality of pressure adjustment mechanisms respectively based on the die cushion pressure command and the pressures detected by the plurality of pressure detectors such that the pressures of the plurality of the first pressure generation chambers become pressures corresponding to the die cushion pressure command.

In the press system with the above configuration, it is possible to control the plurality of first hydraulic cylinders individually. Therefore, even when an eccentric load is applied to the cushion pad, control the pressures of the respective first pressure generation chambers of the plurality of first hydraulic cylinders corresponding to the eccentric load.

BRIEF DESCRIPTION OF THE DRAWINGS

FIG. 20 is a table illustrating a motor capacity, average power during forming and a power supply capacity of the whole press system according to the present invention and prior arts 1 to 3;

DETAILED DESCRIPTION OF THE EMBODIMENTS

Hereinafter, preferred embodiments of a press system according to the present invention will be described in detail with reference to the accompanying drawings.

First Embodiment of Press System

Figure 1:
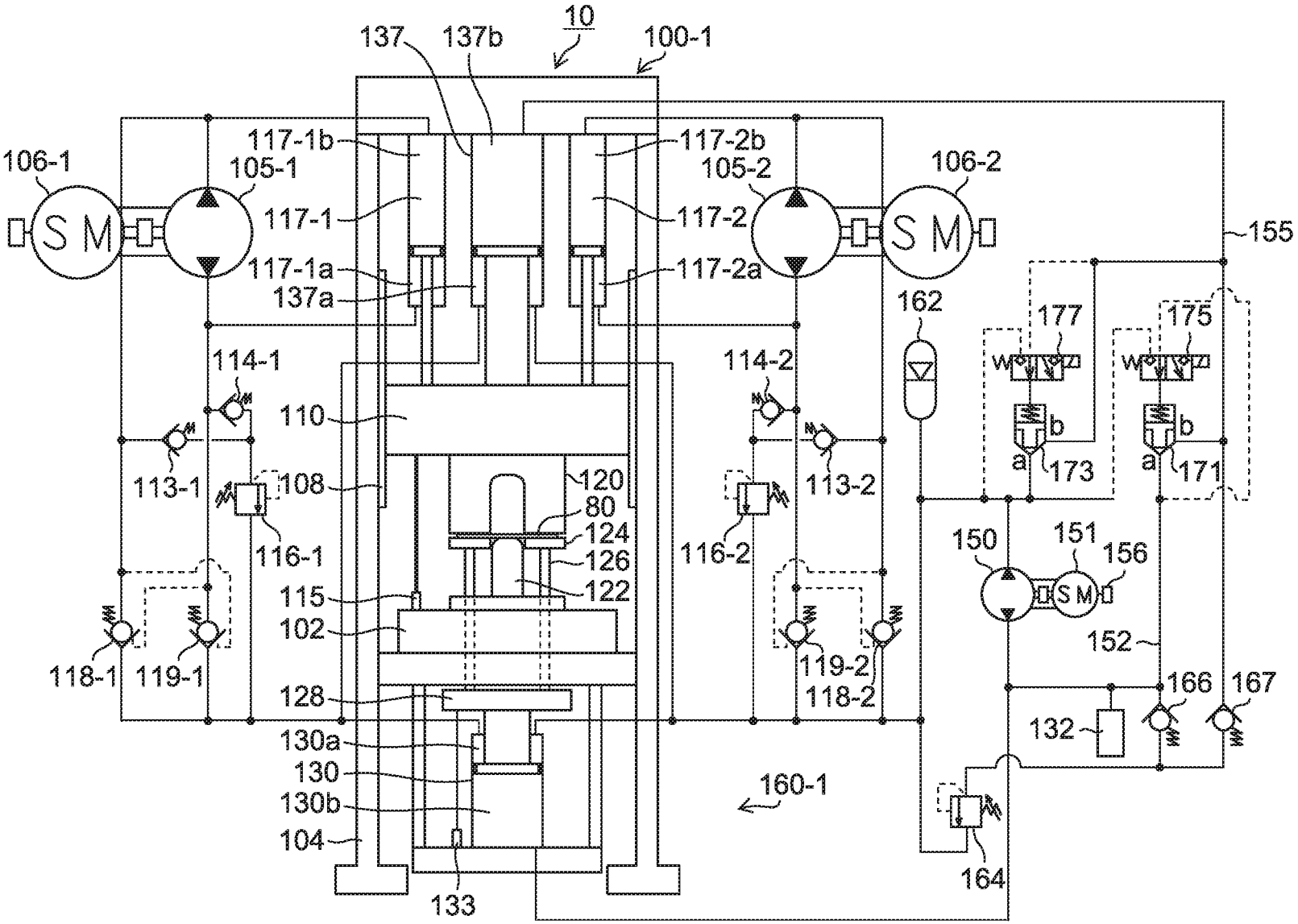
FIG. 1 is a brief configuration diagram illustrating a first embodiment of a press system according to the present invention.

FIG. 1 is a brief configuration diagram illustrating a first embodiment of a press system according to the present invention.

A press system 10 shown in FIG. 1 includes a die cushion apparatus 160-1 and a hydraulic drive mode press machine 100-1. The die cushion apparatus 160-1 includes one hydraulic cylinder 130 which functions as a first hydraulic cylinder, one servo motor 151 (and one hydraulic pump/motor 150 which functions as a hydraulic pump/motor) which functions as a pressure adjustment mechanism for adjusting a pressure of a first pressure generation chamber (pressure generation chamber) **130*b* which is a head-side hydraulic chamber of the hydraulic cylinder 130**, and so on.

Die Cushion Apparatus 160-1

Figure 21:
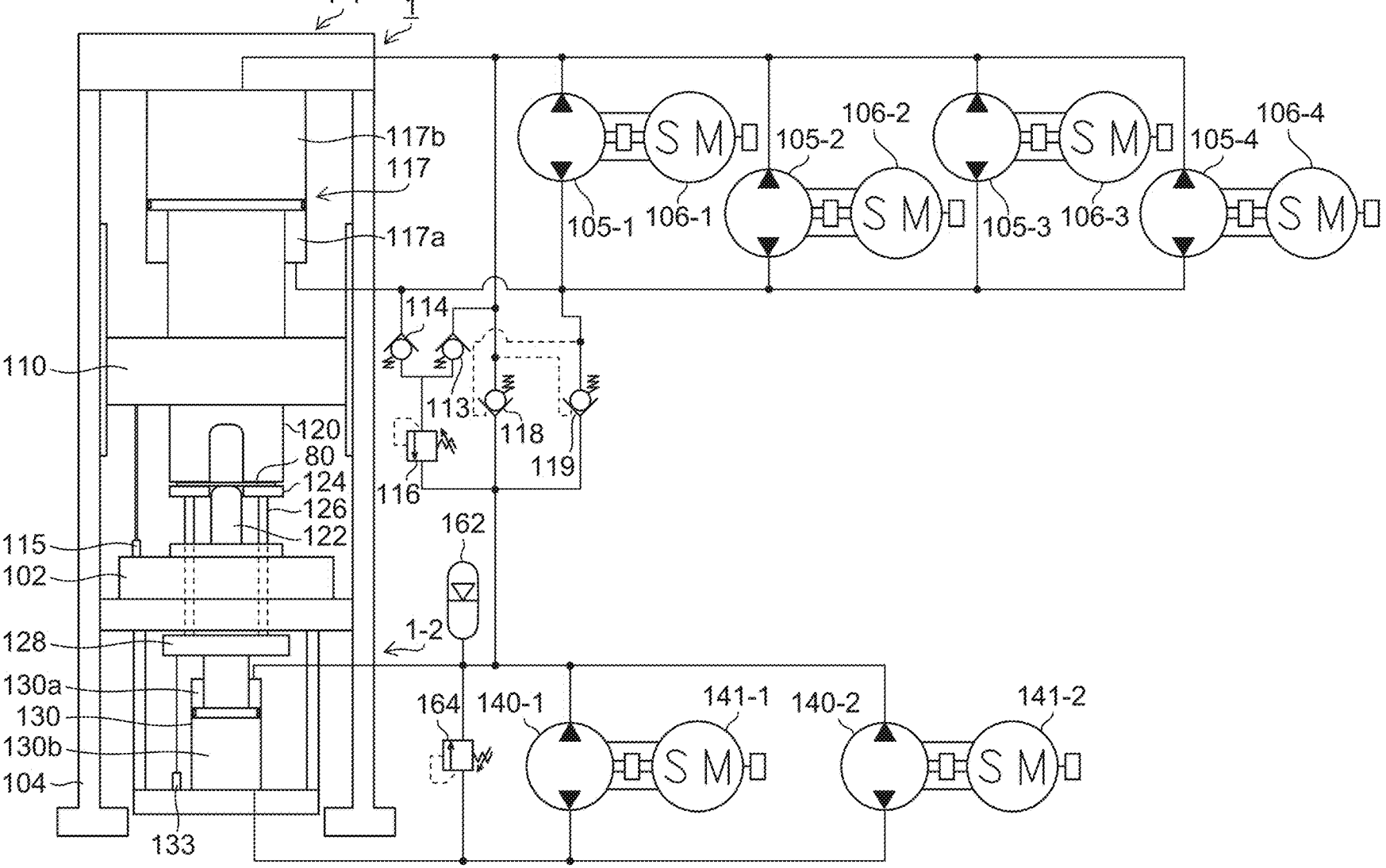
FIG.21 Prior Art
FIG. 21 is a diagram illustrating an example of a press system driven by a conventional servo motor.

The die cushion apparatus 160-1 shown in FIG. 1 is configured to be similar to the die cushion apparatus 1-2 according to Japanese Patent Application Laid-Open No. 2006-315074 shown in FIG. 21. The die cushion apparatus 160-1 includes the hydraulic cylinder 130, the fixed capacity type hydraulic pump/motor 150, the servo motor 151 and a die cushion controller 180-1 (FIG. 3) which controls torque of the servo motor 151 so that a pressure (die cushion pressure) of a pressure generation chamber **130*b* of the hydraulic cylinder 130 becomes a desired pressure. Note that parts of the die cushion apparatus 160-1 shown in FIG. 1 common to the parts of the die cushion apparatus 1-2 shown in FIG. 21** are assigned the same reference numerals.

A cushion pad 128 is supported by the hydraulic cylinder 130 and a position detector 133 which detects the position of the cushion pad 128 is provided in the cushion pad 128. The cushion pad 128 supports a blank holder 124 via a plurality of cushion pins 126. A material (blank material) 80 is set (in contact with) on the top side of the blank holder 124 by a conveyance apparatus (not shown).

A pressure detector 132 which detects a pressure of the pressure generation chamber **130*b* and one discharge port of the hydraulic pump/motor 150 are connected to a pipe 152 which is connected to the head-side hydraulic chamber (hereinafter referred to as "pressure generation chamber") 130*b* which functions as a first pressure generation chamber of the hydraulic cylinder 130**.

An accumulator 162 and the other discharge port of the hydraulic pump/motor 150 are connected to a pipe connected to a rod-side hydraulic chamber **130*a* of the hydraulic cylinder 130**.

Hydraulic oil (hydraulic liquid) having a substantially constant low pressure (system pressure) of around 3 to 15 $kg/cm^2$ is accumulated in the accumulator 162. The accumulator 162 plays the role of a tank (low-pressure source).

A drive shaft of the servo motor 151 is connected to a rotary shaft of the hydraulic pump/motor 150.

A hydraulic cylinder 137 which functions as a second hydraulic cylinder for slide drive (slide-drive hydraulic cylinder) is provided in order to apply the same load as a die cushion load in the opposite direction during the application of the die cushion load. Note that the rod-side hydraulic chamber **130*a* of the hydraulic cylinder 130 and a rod-side hydraulic chamber 137*a* of the hydraulic cylinder 137** are connected to each other via a pipe.

A pilot-drive-type first logic valve 171 is provided between the pipe 152 connected to the pressure generation chamber **130*b* of the hydraulic cylinder 130 for die cushion drive (die-cushion-drive hydraulic cylinder) and a pipe 155 connected to the second pressure generation chamber (pressure generation chamber which is a head-side hydraulic chamber) 137*b* of the slide-drive hydraulic cylinder 137, and the pilot-drive-type first logic valve 171 functions as a valve which blocks or establishes communication between the pipes 152 and 155**.

A first solenoid valve 175 switches a pressure to be applied to the pilot port of the first logic valve 171, to any one of the pressure of the pressure generation chamber 137*b* of the hydraulic cylinder 137 and the system pressure of the accumulator 162. When the first logic valve 171 is blocked, the first solenoid valve 175 is not excited and when the first logic valve 171 is opened (communicated), the first solenoid valve 175 is excited.

A pilot-drive-type logic valve (second logic valve) 173 is used to block or establish communication between the pressure generation chamber 137*b* of the slide-drive hydraulic cylinder 137 and the accumulator 162.

A second solenoid valve 177 switches the pressure to be applied to the pilot port of the second logic valve 173 to one of the pressure of the pressure generation chamber 137*b* of the hydraulic cylinder 137 and the system pressure of the accumulator 162.

When a piston rod (slide 110) of the hydraulic cylinder 137 descends, the second solenoid valve 177 is not excited in a case where the second logic valve 173 establishes communication before starting die cushion force control (forming), and in a case where the second logic valve 173 blocks the communication after starting die cushion force control (forming). When the piston rod (slide 110) of the hydraulic cylinder 137 ascends, the second solenoid valve 177 is excited in a case where the pressure generation chamber 130*b* and the pressure generation chamber 137*b* are not communicated with each other (first solenoid valve 175—non excited), and in a case where the pressure generation chamber 137*b* and the accumulator 162 are communicated with each other.

In the configuration example of the hydraulic circuit in the present embodiment, when the pressure receiving area of the pressure generation chamber 130*b* of the hydraulic cylinder 130 is assumed to be S1 and the pressure receiving area of the pressure generation chamber 137*b* of the hydraulic cylinder 137 is assumed to be S2, the pressure receiving area S1 is preferably slightly (by 3 to 5%) greater than the pressure receiving area S2 of the pressure generation chamber 137*b* of the hydraulic cylinder 137.

When the die cushion force operation starts (the slide 110 indirectly comes into contact with the cushion pad 128), pressure oil ($q_a$) displaced (pushed away) from the pressure generation chamber 130*b* of the hydraulic cylinder 130 starts to flow into the pressure generation chamber 137*b* of the hydraulic cylinder 137 (as $q_b$) via the first logic valve 171. The oil amount difference ($q_a-q_b$) caused by the difference between the pressure receiving areas S1 and S2 can shorten a pressure buildup time relative to the compression volume increased by the combination of the pressure generation chambers of both hydraulic cylinders and/or can boost quick closure of the second logic valve 173.

In a steady state (state when a predetermined time has passed after the start of the die cushion force operation), this oil amount difference is discharged into the accumulator 162 by the hydraulic pump/motor 150 driven by the servo motor 151 (accompanying the pressure control operation of the pressure generation chambers of the combined both hydraulic cylinders).

In this embodiment, the pressure receiving area S1 of the pressure generation chamber 130*b* of the hydraulic cylinder 130 is set to be slightly larger than the pressure receiving area S2 of the pressure generation chamber 137*b* of the hydraulic cylinder 137. However, depending on characteristics of the hydraulic circuit, there is also a case where it might be more suitable that the pressure receiving area S1 of the pressure generation chamber 130*b* of the hydraulic cylinder 130 is set to be slightly smaller than the pressure receiving area S2 of the pressure generation chamber 137*b* of the hydraulic cylinder 137, contrary to the embodiment.

Therefore, the pressure receiving areas S1 and S2 are set within a range of $0.95\times S1\leq S2\leq 1.05\times S1$ as appropriate.

Note that when priority is given to energy efficiency, S1=S2 is set. This is because the volume of the pressure oil displaced (pushed away) from the pressure generation chamber 137*b* of the hydraulic cylinder 130 becomes equal to the volume of the pressure oil flowing into the pressure generation chamber 137*b* of the hydraulic cylinder 137 for the die cushion force operation period, thus improving the energy efficiency.

Furthermore, a prefill valve may also be used instead of the second logic valve 173.

A linear motion type relief valve 164 operates as a safety valve. When an abnormal pressure is generated in the pressure generation chamber 130*b* of the hydraulic cylinder 130 or the pressure generation chamber 137*b* of the hydraulic cylinder 137, the pressure oil responsible for generating the abnormal pressure is relieved to the accumulator 162 via the check valves 166 and 167.

Press Machine 100-1

The press machine 100-1 shown in FIG. 1 is provided with the hydraulic cylinder 137 which functions as a second hydraulic cylinder and a plurality of (two) hydraulic cylinders 117-1 and 117-2 which function as third hydraulic cylinders. The slide 110 is guided in a freely movable manner in the vertical direction in FIG. 1 by a sliding member 108 provided in a column 104 and driven in the vertical direction by the hydraulic cylinders 137, 117-1 and 117-2.

The hydraulic cylinder 137 generates part of the press load to be applied to the slide 110 when the slide 110 descends and the hydraulic cylinders 117-1 and 117-2 generate residual press load (press load corresponding to the forming load) other than the part of the press load when the slide 110 descends.

Both ports (hydraulic connection ports) of hydraulic pumps/motors 105-1 and 105-2 respectively shaft-connected to servo motors 106-1 and 106-2 are connected to the rod-side hydraulic chambers 117-1*a* and 117-2*a* and head-side hydraulic chambers (pressure generation chambers) 117-1*b* and 117-2*b* of the hydraulic cylinders 117-1 and 117-2 respectively.

While piston rods of the hydraulic cylinders 117-1 and 117-2 are ascending, pilot-drive-type check valves 118-1 and 118-2 are opened by pressures (load pressures) acting on the rod-side hydraulic chambers 117-1*a* and 117-2*a* so as to cause pressure generation chambers 117-1*b* and 117-2*b* of the hydraulic cylinders 117-1 and 117-2 to communicate with the accumulator 162 respectively.

While the piston rods of the hydraulic cylinders 117-1 and 117-2 are descending, pilot-drive-type check valves 119-1 and 119-2 are opened by pressures (load pressures) acting on the head-side hydraulic chambers (pressure generation chambers) 117-1*b* and 117-2*b* so as to cause the rod-side hydraulic chambers 117-1*a* and 117-2*a* of the hydraulic cylinders 117-1 and 117-2 to communicate with the accumulator 162 respectively.

In the hydraulic cylinders 117-1 and 117-2, the rod-side hydraulic chambers have areas which are different from areas of the head-side hydraulic chambers (pressure generation chambers). The piston rods of the hydraulic cylinders 117-1 and 117-2 move up and down in the vertical direction. During the ascent of the piston rods, out of the oil amount which is pushed away from the pressure generation chambers 117-1*b* and 117-2*b*, the extra oil amount which cannot been absorbed by the hydraulic pumps/motors 105-1 and 105-2 is discharged into the accumulator 162 via the pilot-drive-type check valves 118-1 and 118-2. On the other hand, during the descent of the piston rods, the hydraulic oil is supplied to the pressure generation chambers 117-1*b* and 117-2*b* by the hydraulic pumps/motors 105-1 and 105-2 and the oil amount corresponding to the descent amount of the piston rods is pushed away from the rod-side hydraulic chambers 117-1*a* and 117-2*a*. However, the oil amount pushed away from the rod-side hydraulic chambers 117-1*a* and 117-2*a* is insufficient for the oil amount supplied to the pressure generation chambers 117-1*b* and 117-2*b* in response to the descent of the piston rod. Therefore, the insufficient oil amount is drawn from the accumulator 162 by the hydraulic pumps/motors 105-1 and 105-2 via the pilot-drive-type check valves 119-1 and 119-2.

Linear motion type relief valves 116-1 and 116-2 operate as safety valves. When abnormal pressures are generated in the rod-side hydraulic chambers 117-1*a* and 117-2*a*, and the pressure generation chambers 117-1*b* and 117-2*b*, the pressure oil responsible for generating the abnormal pressure is relieved to the accumulator 162 via check valves 113-1, 113-2, 114-1 and 114-2.

Based on a slide position command (A) for causing the slide 110 to move in the vertical direction, a slide position signal (B) detected from a position detector 115 which detects the position of the slide 110, and an angular velocity signal 1 (C1) and an angular velocity signal 2 (C2) (not shown) of the servo motors 106-1 and 106-2, a torque command 1 (from A, B, C1) and a torque command 2 (A, B, C2) are calculated. The calculated torque command 1 and torque command 2 are outputted to the servo motors 106-1 and 106-2 via the respective servo amplifiers to drive the slide-drive hydraulic cylinders 117-1 and 117-2, thereby causing the slide 110 to move in the vertical direction.

An upper die 120 is mounted on a die mounting surface of the slide 110 and a lower die 122 is mounted on a top surface of a bolster 102.

Comparison Between Present Invention and Prior Art

In the conventional press system 1 shown in FIG. 21, the main drive mechanism for slide drive (slide-drive main drive mechanism) and the main drive mechanism for die cushion (cushion pad) drive (die-cushion-drive main drive mechanism) are completely separated from each other. Therefore, the press machine 1-1 needs to bear (provide) a press load action and power associated therewith, while the die cushion apparatus 1-2 needs to bear (provide) a die cushion load action and power associated therewith.

In drawing, it is considered that a press load needs to be (to be prepared as) approximately twice a die cushion load. Therefore, if the pressure receiving area of the pressure generation chamber 117*b* of the hydraulic cylinder 117 for slide drive (slide-drive hydraulic cylinder) is assumed to be S8 (the number represents the magnitude of the pressure receiving area), the pressure receiving area of the pressure generation chamber 130*b* of the hydraulic cylinder 130 for die cushion drive (die-cushion-drive hydraulic cylinder) can be assumed to be S4.

Furthermore, the power in a die cushion load action step is substantially proportional to the ratio between the pressure receiving area of the pressure generation chamber 117*b* of the hydraulic cylinder 117 and the pressure receiving area of the pressure generation chamber 130*b* of the hydraulic cylinder 130. Therefore, if the capacity of the four servo motors 106-1 to 160-4 for slide drive (slide-drive servo motors) is assumed to be M4×4=M16 (the number represents a motor capacity), the capacity of the two servo motors 141-1 and 141-2 for die cushion drive (die-cushion-drive servo motors) can be assumed to be M4×2=M8. Thus, as the whole system, servo motors need to have a capacity corresponding to a M24 (=M4×4+M4×2) in total.

On the other hand, as described above, in the press system 10 shown in FIG. 1 according to the first embodiment of the present invention, the slide-drive main drive mechanism and the die-cushion-drive main drive mechanism are considered as an integrated drawing system and are not completely separated from each other.

In order to be comparable with the conventional press system 1, all aspects of the press system 10 according to the first embodiment are shown on a common scale, but the pressure receiving area of the pressure generation chamber 130*b* of the die-cushion-drive hydraulic cylinder 130 in the press system 10 is S4 just like the conventional press system 1.

Furthermore, the sum total of the pressure receiving areas of the pressure generation chambers 137*b*, 117-1*b* and 117-2*b* of the slide-drive hydraulic cylinders 137, 117-1 and 117-2 is also S8 just like the conventional press system 1.

However, the pressure receiving area S8 is divided into the pressure receiving area S4 of the pressure generation chamber 137*b* of the slide-drive hydraulic cylinder 137 equal to the die-cushion-drive hydraulic cylinder 130, and the pressure receiving area S4 (S2×2 in this embodiment) of the pressure generation chambers 117-1*b* and 117-2*b* of the other slide-drive hydraulic cylinders 117-1 and 117-2.

In the die cushion load action step (in which the speeds of both hydraulic cylinders become substantially the same), the pressure generation chamber 130*b* of the die-cushion-drive hydraulic cylinder 130 communicates with the pressure generation chamber 137*b* of the slide-drive hydraulic cylinder 137 via the first logic valve 171. Therefore, the die cushion load and the power associated with the die cushion load action basically cancel each other (except the loss caused by leakage in the hydraulic pump/motor).

Thus, for slide drive, the required servo motor capacity is M4×2=M8 corresponding to the two servo motors 106-1 and 106-2 which generate a net forming load (except for the die cushion load). For die cushion drive, the required servo motor capacity is M1×1 to be used for pressure buildup (to obtain pressure corresponding to the die cushion load), for leakage loss compensation or for handling a case where the cushion pad 128 singly performs a knockout operation. The whole system requires the servo motors 106-1, 106-2 and 151 which have a total capacity corresponding to M9 (=M4×2+M1).

Therefore, the capacity of the servo motor in the press system 10 is reduced by 60% or more in the whole system compared to the prior art. Regarding the portion associated with the die cushion load, since the die cushion load occupies the most of the press load (larger than at least 50% of the press load), the effect achieved by the servo motor reduction is outstanding.

Second Embodiment of Press System

Figure 2:
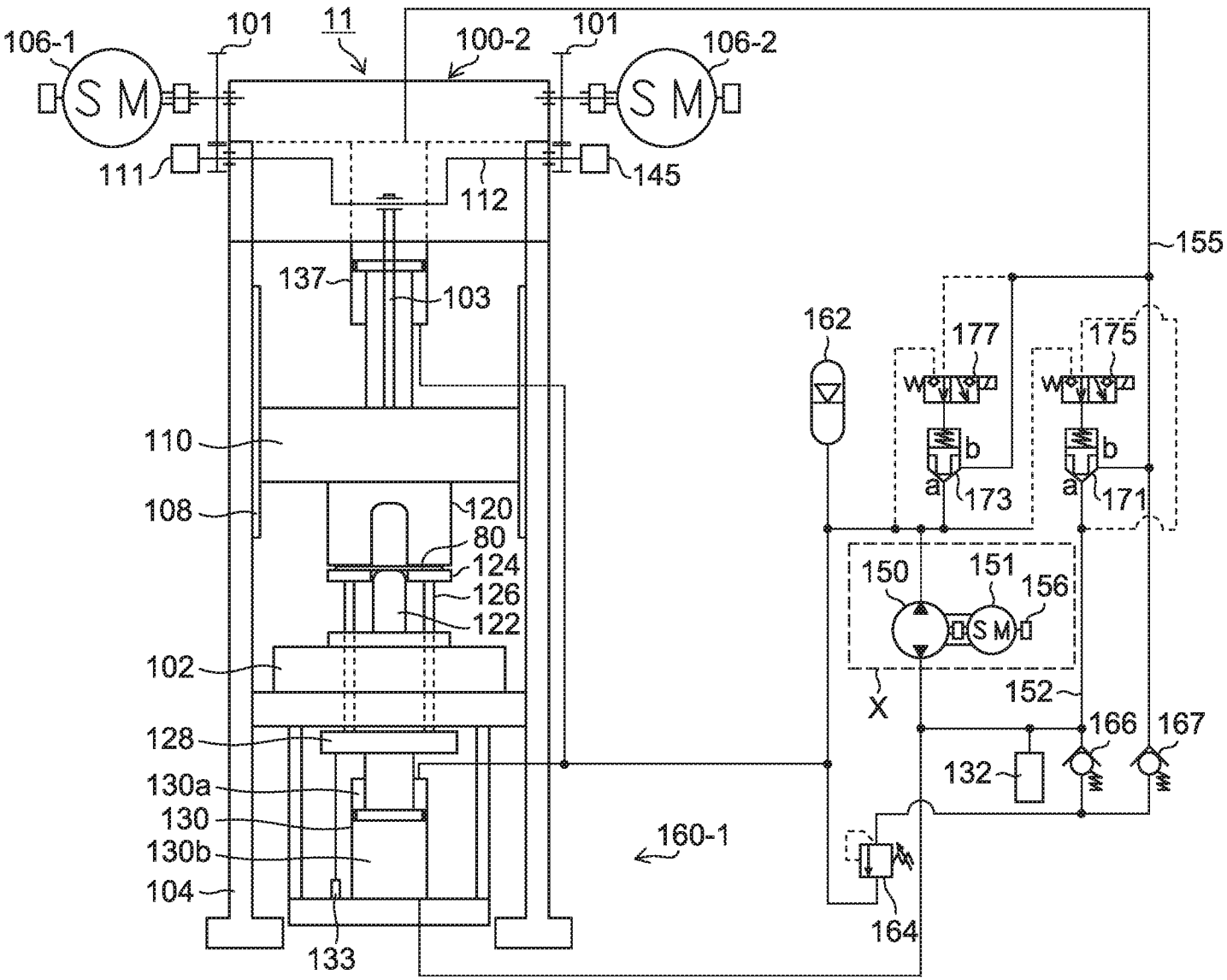
FIG. 2 is a brief configuration diagram illustrating a second embodiment of the press system according to the present invention.

FIG. 2 is a brief configuration diagram illustrating a second embodiment of the press system according to the present invention.

A press system 11 shown in FIG. 2 includes the die cushion apparatus 160-1 shown in FIG. 1 and a mechanical (crank) drive mode press machine 100-2.

The press machine 100-2 shown in FIG. 2 is mainly different from the press machine 100-1 shown in FIG. 1 in that the press machine 100-2 is provided with a mechanical drive unit which mechanically generates a press load in the slide 110 when the slide 110 descends, instead of the hydraulic cylinders 117-1 and 117-2 of the press machine 100-1 shown in FIG. 1. This mechanical drive unit includes a crank shaft 112, a connecting rod 103 which connects the crank shaft 112 and the slide 110, servo motors 106-1 and 106-2 which function as crank shaft drive units and a reduction gear 101.

A rotary drive force is transmitted to the crank shaft 112 from the servo motors 106-1 and 106-2 via the reduction gear 101. The rotary motion of the crank shaft 112 is converted to linear motion by the connecting rod 103, and transmitted to the slide 110 to drive the slide 110 in the vertical direction.

The crank shaft 112 is provided with an angle detector 111 which detects an angle of the crank shaft 112 and an angular velocity detector 145 which detects an angular velocity of the crank shaft 112.

Since the press system 11 according to the second embodiment is common to the press system 10 according to the first embodiment shown in FIG. 1 in other aspects, detailed description thereof will be omitted.

Furthermore, the press system 11 according to the second embodiment includes the same number of servo motors 106-1, 106-2 and 151 with the same capacity as the press system 10 according to the first embodiment, and the capacity of the servo motors of the press system 11 can be reduced by 60% or more compared to the prior art as the whole system.

Die Cushion Controller 180-1

Figure 3:
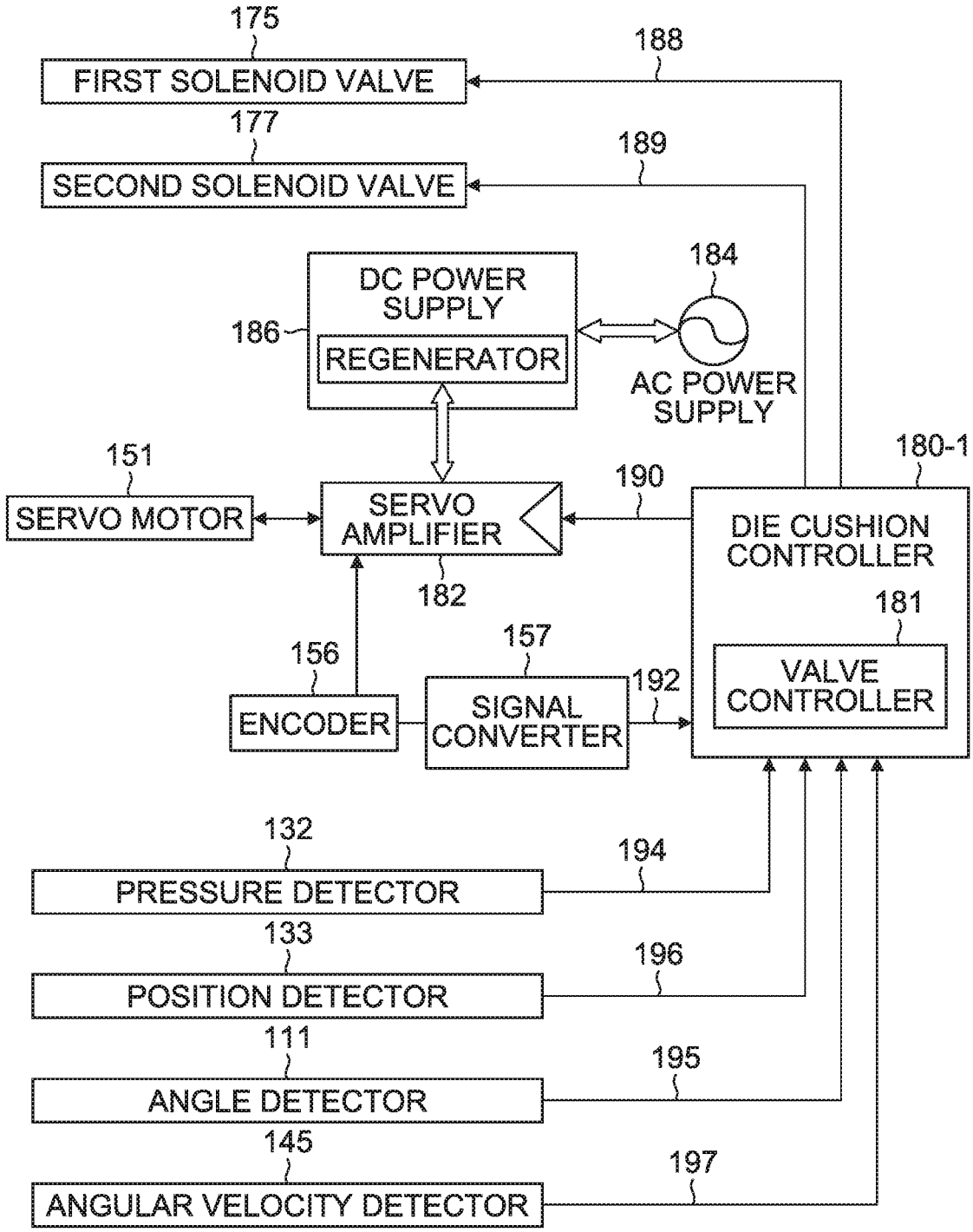
FIG. 3 is a block diagram illustrating a die cushion controller which controls a die cushion apparatus constituting the press system shown in FIG. 2 and an input/output unit thereof.

FIG. 3 is a block diagram illustrating a die cushion controller 180-1 which controls the die cushion apparatus 160-1 constituting the press system 11 shown in FIG. 2 and an input/output unit thereof.

The die cushion controller 180-1 shown in FIG. 3 switches a control state between a pressure control state in which a die cushion pressure (die cushion load) applied to the cushion pad 128 is controlled by the hydraulic cylinder 130 and a position control state in which a position of the cushion pad 128 is controlled by the hydraulic cylinder 130, calculates a torque command 190 in the respective control states, outputs the calculated torque command 190 to the servo motor 151 via a servo amplifier 182 and controls torque of the servo motor 151.

Furthermore, the die cushion controller 180-1 includes a valve controller 181. The valve controller 181 outputs drive commands 188 and 189 to individually excite or non-excite solenoids of the first solenoid valve 175 and the second solenoid valve 177, and controls opening/closing (ON/OFF) of the first logic valve 171 and the second logic valve 173 via the first solenoid valve 175 and the second solenoid valve 177.

The die cushion controller 180-1 includes a die cushion pressure command unit which outputs a predetermined die cushion pressure command and receives a die cushion pressure signal 194 from the pressure detector 132 in order to control a pressure (die cushion pressure) of the pressure generation chamber 130*b* of the hydraulic cylinder 130 according to the die cushion pressure command outputted from the die cushion pressure command unit in a pressure control state.

In a case where the cushion pad 128 is waiting (held) at an initial position during a knockout operation of a press-formed product, or in a case where the hydraulic cylinder 130 is caused to singly move in the vertical direction in a position control state, the die cushion controller 180-1 receives a die cushion position signal 196 indicating the position of the cushion pad 128 from the position detector 133 as a position feedback signal.

The die cushion controller 180-1 receives a crank angle signal 195 indicating an angle of the crank shaft 112 from the angle detector 111. The crank angle signal 195 is used to count a timing when the die cushion force control starts (die cushion force start timing), count a timing when the knockout starts (knockout start timing) or correct (convert to a slide position signal) a position command during a knockout operation.

Furthermore, when there is a difference in pressure receiving areas between the pressure generation chambers 130*b* and 137*b* of the hydraulic cylinder 130 and the hydraulic cylinder 137, the die cushion controller 180-1 receives a crank angular velocity signal 197 indicating an angular velocity of the crank shaft 112 from the angular velocity detector 145 in order to correct an unbalanced oil amount (L/m), in other words, in order to convert the signal 197 to a slide speed signal and calculate/estimate the unbalanced oil amount from the slide speed signal.

Furthermore, the die cushion controller 180-1 receives a motor angular velocity signal 192 generated via a signal converter 157 from an encoder 156 which detects rotation of the servo motor 151, as an angular velocity feedback signal to secure mainly dynamic stability of the die cushion pressure.

The hydraulic pump/motor 150 is driven by the servo motor 151 whose torque is controlled based on a torque command 190 from the die cushion controller 180-1. In a die cushion pressure control state in which the die cushion pressure is controlled, the hydraulic pump/motor 150 is controlled such that the pressure of the total oil amount that fills the pressure generation chambers 130*b* and 137*b* of the hydraulic cylinders 130 and 137 and pipes 152 and 155 which connect these pressure generation chambers 130*b* and 137*b* becomes a pressure corresponding to the die cushion pressure command.

During die cushion pressure control, in a case where the slide 110 descends (during forming) from colliding with a material 80 (and a blank holder 124) till reaching to a bottom dead center, if the (pressure receiving area of the pressure generation chamber 137*b* of the hydraulic cylinder 130) S1 is slightly (by 3 to 5%) greater than the (the pressure receiving area of the pressure generation chamber 137*b* of the hydraulic cylinder 137) S2, the hydraulic pump/motor 150 is displaced (driven) by the oil amount difference ($q_a$−$q_b$) obtained by subtracting pressure oil amount ($q_b$) flown into the pressure generation chamber 137*b* of the hydraulic cylinder 137 via the first logic valve 171 from the pressure oil amount ($q_a$) flown out from the pressure generation chamber 130*b* of the hydraulic cylinder 130. Therefore, the torque of the servo motor 151 is output in a direction which hinders (is opposite to) the rotation (drive) of the hydraulic pump/motor 150. That is, power received by the cushion pad 128 from the slide 110 causes pressure oil to flow from the pressure generation chamber 130*b* of the hydraulic cylinder 130 into the hydraulic pump/motor 150 and the hydraulic pump/motor 150 operates as a hydraulic motor. The hydraulic pump/motor 150 drives the servo motor 151 such that the servo motor 151 operates as a power generator. The power generated by the servo motor 151 is regenerated to an AC power supply 184 from the servo amplifier 182 via a DC power supply 186 having a power regenerator.

ON/OFF of the first logic valve 171 or the second logic valve 173 is individually controlled by the first solenoid valve 175 or the second solenoid valve 177 controlled by a drive command 188 or 189 from the valve controller 181. The first logic valve 171 is turned ON in a case where the pressure generation chambers 130*b* and 137*b* of the hydraulic cylinders 130 and 137 communicate with each other during the die cushion pressure control state. The second logic valve 173 is turned ON in a case where the communication between the pressure generation chambers 130*b* and 137*b* of the hydraulic cylinders 130 and 137 are blocked, the slide 110 is caused to ascend during a knockout operation period of controlling the position of the cushion pad 128, and hydraulic oil displaced (pushed away) from the pressure generation chamber 137*b* of the hydraulic cylinder 137 is recovered into the accumulator 162 via the second logic valve 173.

Note that details of control of the first solenoid valve 175 and the second solenoid valve 177 (first logic valve 171 and second logic valve 173) will be described later. Furthermore, the die cushion controller of the press system 11 according to the first embodiment shown in FIG. 1 can also be configured in the same way as the die cushion controller 180-1 of the press system 11 according to the second embodiment.

Third Embodiment of Press System

Figure 4:
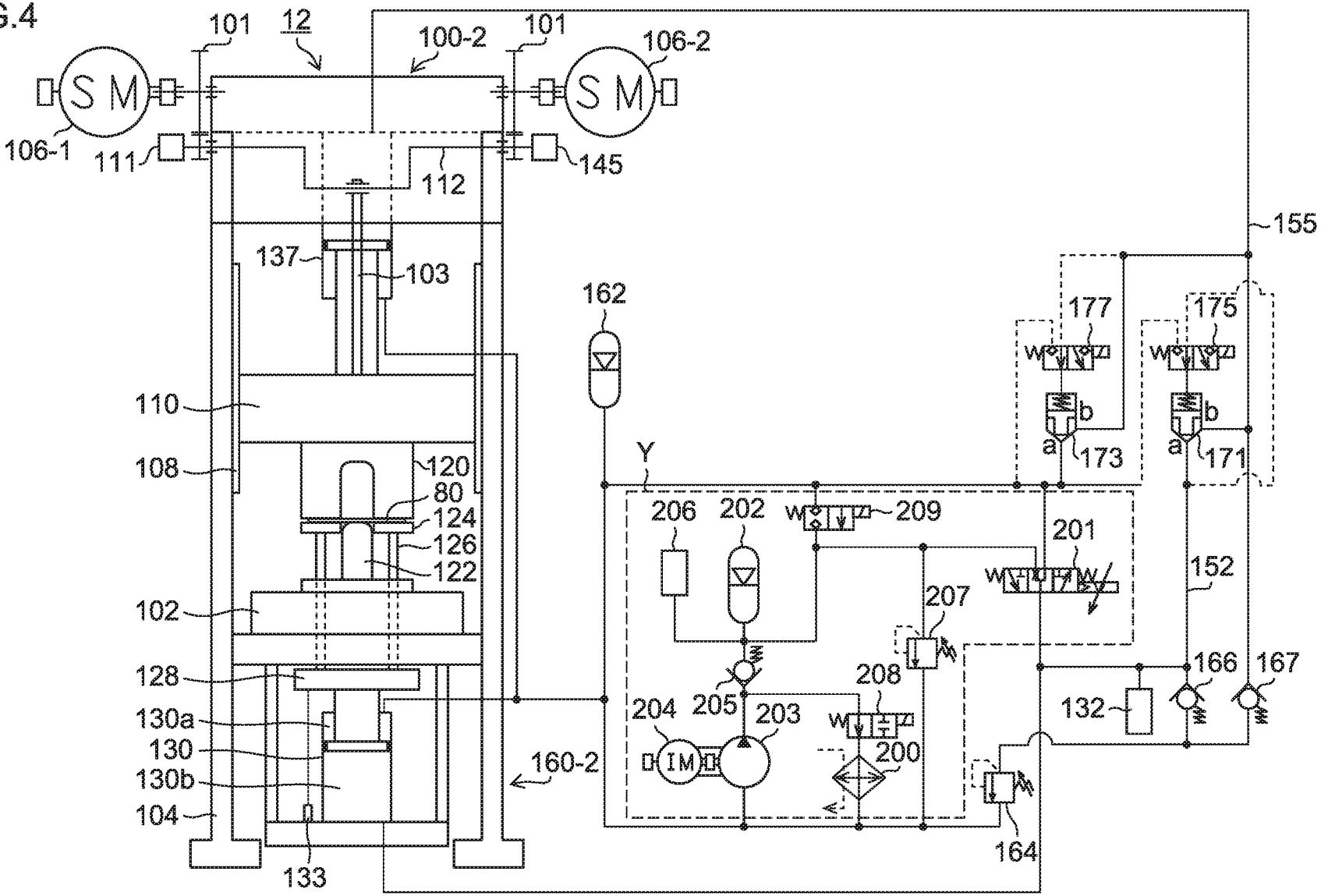
FIG. 4 is a brief configuration diagram illustrating a third embodiment of the press system according to the present invention.

FIG. 4 is a brief configuration diagram illustrating a third embodiment of the press system according to the present invention.

A press system 12 shown in FIG. 4 is different from the press system 11 shown in FIG. 2 in that the press system 12 is provided with a hydraulic circuit Y encircled by a dotted line, instead of a hydraulic circuit (hydraulic circuit including the servo motor 151 and the hydraulic pump/motor 150) X of the press system 11 encircled by a dotted line in FIG. 2. Note that in FIG. 4, parts common to the parts of the press system 11 are assigned the same reference numerals and detailed description thereof will be omitted.

The hydraulic circuit Y of the press system 12 shown in FIG. 4 is provided with a servo valve 201 and an accumulator 202 which functions as a high-pressure source.

The servo valve 201 is connected to the pressure generation chamber 130*b* of the hydraulic cylinder 130 and provided in parallel to the first logic valve 171. The accumulator 202 accumulates hydraulic oil having a substantially constant high-pressure equal to a predetermined die cushion pressure or higher and can supply the hydraulic oil to the servo valve 201.

Figure 5:
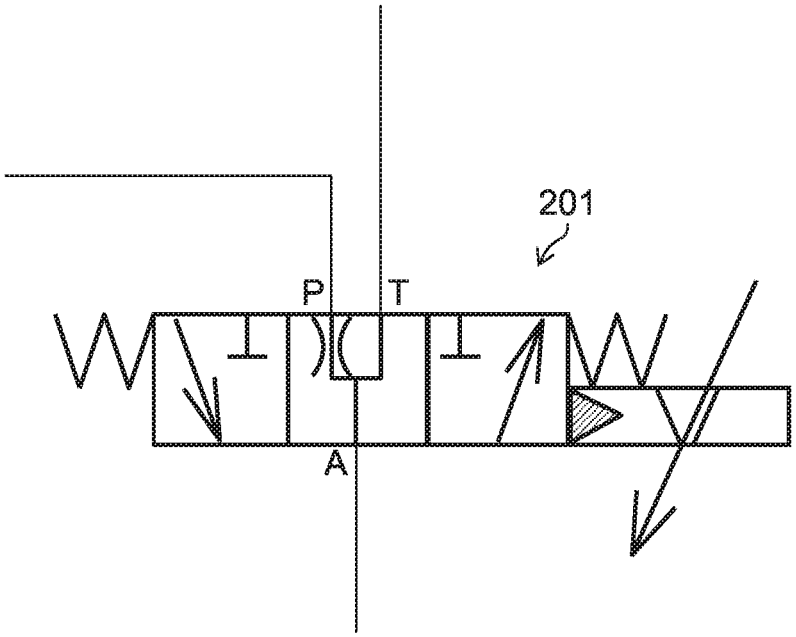
FIG. 5 is an enlarged view of the servo valve shown in FIG. 4.

FIG. 5 is an enlarged view of the servo valve shown in FIG. 4. As shown in FIG. 5, the substantially constant high pressure equal to a predetermined (maximum) die cushion pressure or higher stored (pressure accumulated) in the accumulator 202 is applied to a P port of the servo valve 201. A substantially constant low pressure stored (pressure accumulated) in the accumulator 162 is applied to a T port of the servo valve 201. An a port ("a" port) is disposed on the side of the pressure generation chamber 130*b* of the hydraulic cylinder 130.

As the servo valve 201, one with an underlap structure is suitable for pressure control in which in a case where a spool is positioned at a neutral point, the P port is slightly open to the T port (via a throttle) and in a case where the opening degree of the servo valve 201 is changed (opened and closed) in the vicinity of 0 (corresponding to the neutral point of the spool), the pressure is easy to be gently changed (increase and decrease) with respect to the (compression) volume which is substantially constant.

Figure 6:
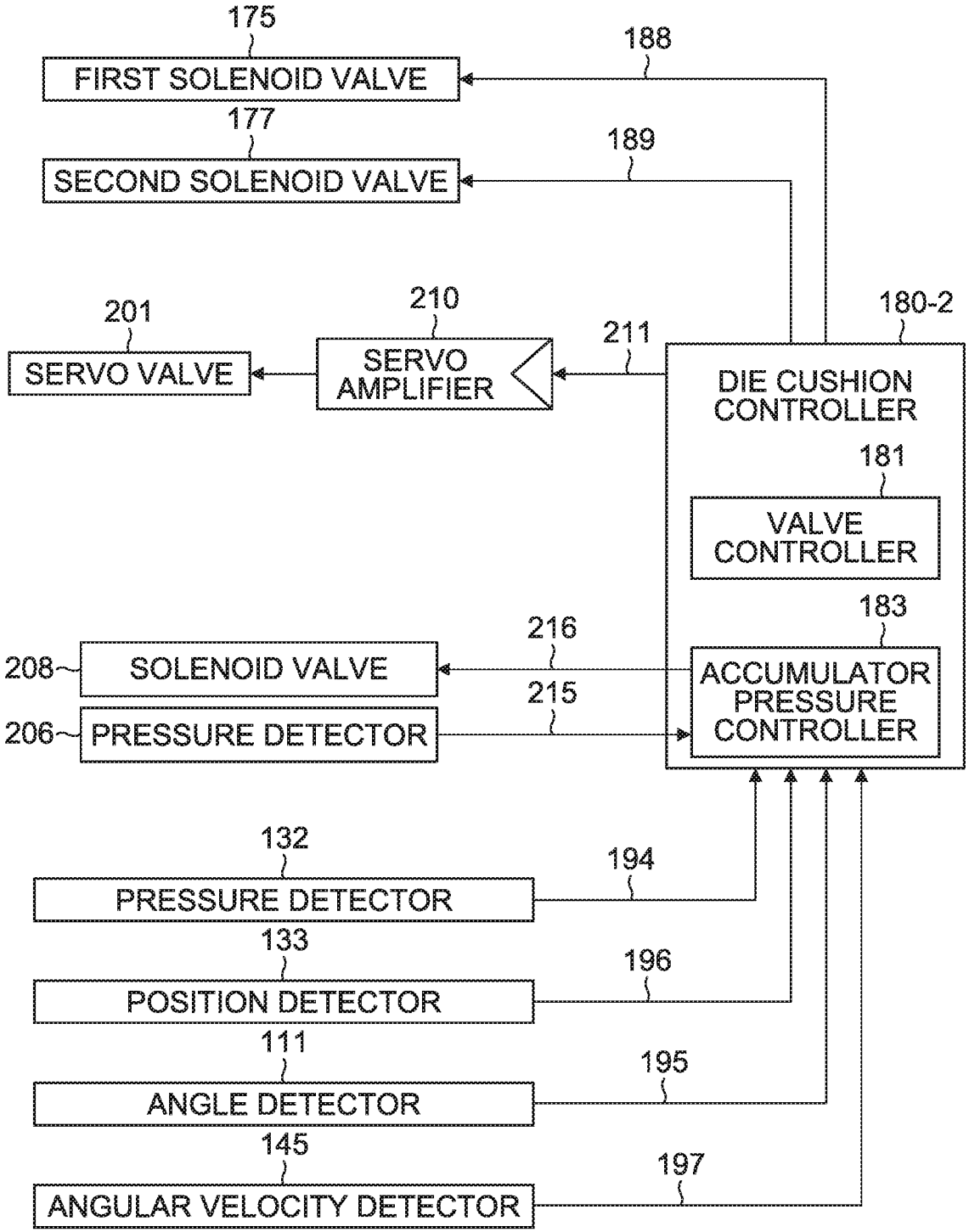
FIG. 6 is a block diagram illustrating a die cushion controller which controls a die cushion apparatus constituting the press system shown in FIG. 4 and an input/output unit thereof.

FIG. 6 is a block diagram illustrating a die cushion controller 180-2 which controls a die cushion apparatus 160-2 provided in the press system 11 shown in FIG. 4 and an input/output unit thereof. Note that in FIG. 6, parts common to the parts of the die cushion controller 180-1 shown in FIG. 3 and the input/output unit thereof are assigned the same reference numerals and detailed description thereof will be omitted.

The die cushion controller 180-2 is different from the die cushion controller 180-1 in that the die cushion controller 180-2 outputs a servo valve opening command 211 which controls the servo valve 201 and a solenoid valve ON command 216 of a solenoid valve 208, instead of outputting the torque command 190 for controlling torque of the servo motor 151.

An accumulator pressure controller 183 included in the die cushion controller 180-2 outputs a solenoid valve ON command for turning ON the solenoid valve 208 based on a pressure detection signal 215 detected by the pressure detector 206.

That is, in a case where the pressure detection signal (pressure detection signal indicating the pressure stored in the accumulator 202) 215 of the pressure detector 206 indicates a lower limit or less of a substantially constant high-pressure set value, the accumulator pressure controller 183 outputs the solenoid valve ON command 216 which turns ON (the pump is shifted to on-load state) the solenoid valve (pressure accumulation solenoid valve) 208 until the pressure detection signal indicates an upper limit or higher of the substantially constant high-pressure set value.

Returning to FIG. 4, a check valve 205 is equipped so as to keep a substantially constant high pressure in a case where the solenoid valve 208 is OFF (in a case where the pump is in unload state). During the unload state, in a process of the hydraulic oil discharged from the hydraulic pump 203 passing through the solenoid valve 208 and returning to the low-pressure line, the hydraulic oil passes through an oil cooler 200 and is thereby cooled. A relief valve 207 functions as a safety valve. A solenoid valve (pressure releasing solenoid valve) 209 is equipped to release the substantially constant high pressure (safely) in a case where the machine is not in use. Reference numeral 204 indicates an induction motor.

In a die cushion force operation step which is one of the features of the present invention (carrying out a main operation), the die cushion controller 180-2 shown in FIG. 6 outputs the servo valve opening command 211 to the servo valve 201 via a servo amplifier 210 based on mainly the die cushion pressure command signal and the die cushion pressure signal 194 detected by the pressure detector 132. Thereby, the die cushion controller 180-2 controls (the opening of) the servo valve 201 so that the die cushion pressure signal 194 matches (conforms with) the die cushion pressure command signal.

In a steady state except when the die cushion force operation starts, the servo valve 201 carries out the function of supplementing the oil amount leaking to the low-pressure side from a b port of the opened first logic valve 171 via a pilot port. In addition, the servo valve 201 carries out the function of supplying a slight amount of oil in a case where the pressure is changed (increased) in the direction of increasing a die cushion force, and the function of discharging a slight amount of oil in a case where the pressure is changed (decreased) in the direction of decreasing a die cushion force. The spool of the servo valve 201 preferably has an underlap structure so that pressure control becomes easy in the vicinity of a neutral point.

In the conventional die cushion apparatus adopting a scheme of controlling a pressure (applied only to) of a hydraulic cylinder for die cushion pressure generation by a servo valve, the servo valve handles (processes) a large amount of oil flown out from the hydraulic cylinder. On the other hand, in the press system 12 according to the third embodiment, the pressure generation chamber 130*b* of the hydraulic cylinder 130 for die cushion pressure generation communicates with the pressure generation chamber 137*b* of the slide-drive hydraulic cylinder 137, and the servo valve 201 is used. Because the press system 12 basically does not handle (process) oil amounts except the above-described slight oil amount, the press system 12 suffers few decrease in energy efficiency which is a disadvantage of the servo valve. Further, in the press system 12, the advantageous features of the servo valve such as accuracy (of opening control depending on selection) and excellent responsiveness become dominant. The press system 12 according to the third embodiment is not inferior in function, compared to the press systems 10 and 11 according to the first and second embodiments in which the servo motor 151 (and the fixed capacity type hydraulic pump/motor 150) is used.

Fourth Embodiment of Press System

Figure 7:
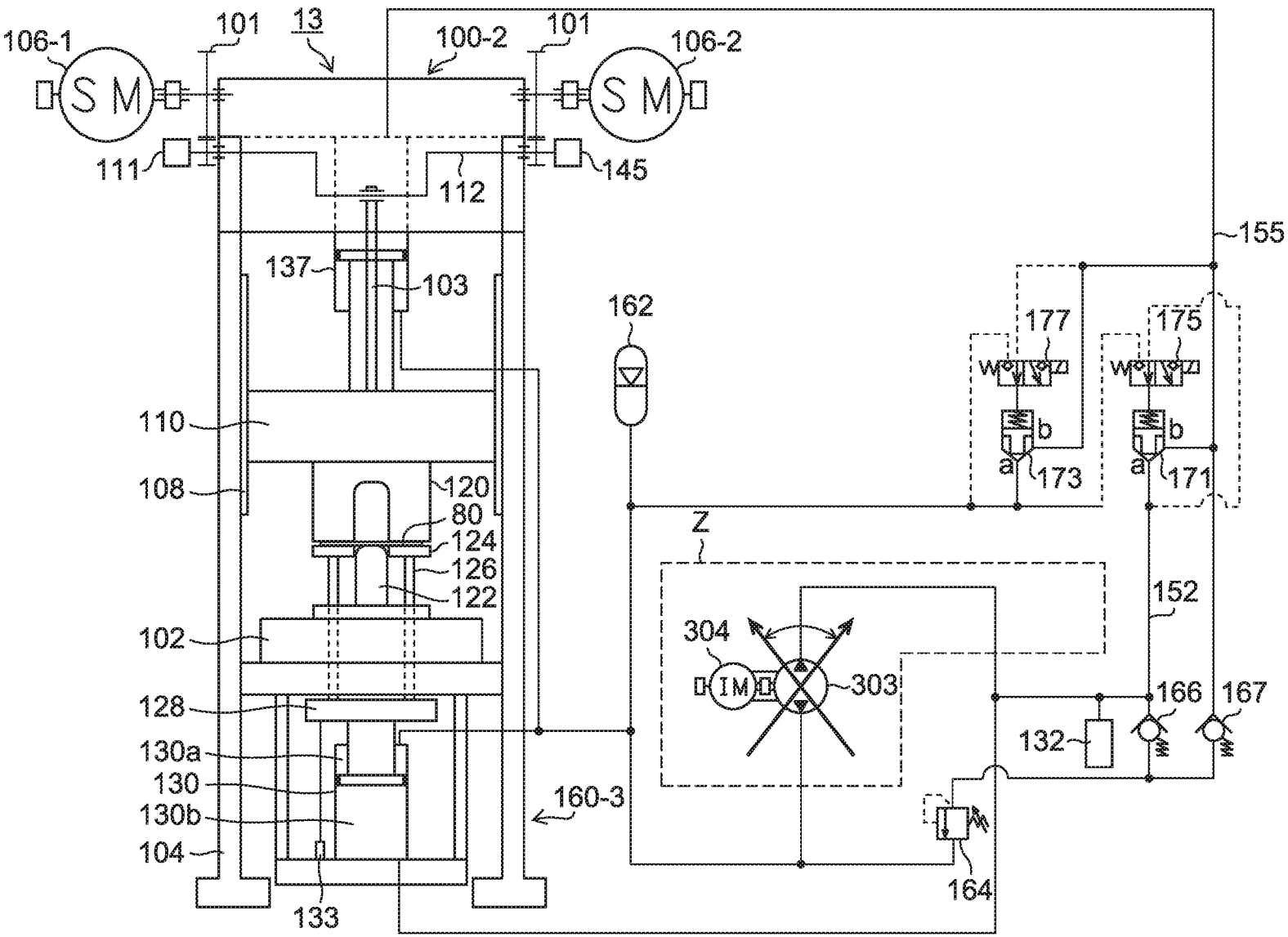
FIG. 7 is a brief configuration diagram illustrating a fourth embodiment of the press system according to the present invention.

FIG. 7 is a brief configuration diagram illustrating a fourth embodiment of the press system according to the present invention.

The press system 13 shown in FIG. 7 is different from the press system 11 shown in FIG. 2 in that a hydraulic circuit Z encircled by a dotted line is provided instead of the hydraulic circuit X encircled by a dotted line of the press system 11 in FIG. 2. Note that parts in FIG. 7 common to the parts of the press system 11 are assigned the same reference numerals and detailed description thereof will be omitted.

The hydraulic circuit Z of the press system 13 shown in FIG. 7 includes a variable capacity type hydraulic pump 303 which functions as a bidirectional variable capacity type hydraulic pump and an electric motor (induction motor) 304 driven at a substantially constant rotating speed.

The variable capacity type hydraulic pump 303 is provided in parallel to the first logic valve 171, one port of the variable capacity type hydraulic pump 303 is disposed on the side of the pressure generation chamber 130*b* of the hydraulic cylinder 130 and the other port is disposed on a line (system pressure line) having a substantially constant low-pressure stored (pressure accumulated) in the accumulator 162.

The variable capacity type hydraulic pump 303 is shaft-connected to the rotary shaft of the induction motor 304 driven at a substantially constant rotating speed. The variable capacity type hydraulic pump 303 can change the displacement volume of the hydraulic oil bidirectionally centered on "0" and can discharge an oil amount proportional to the displacement volume in the direction from the pressure generation chamber 130*b* toward the system pressure line and in the direction from the system pressure line toward the pressure generation chamber 130*b*.

The variable capacity type hydraulic pump 303 is preferably a bidirectional variable swash-plate-(angle)-type axial piston pump in which a displacement volume is proportional to a swish plate angle (accompanied by movable mass with relatively low inertia). It is also possible to use a bidirectional inclined-shaft-(angle)-type axial piston pump in which a displacement volume is proportional to an inclined shaft angle (accompanied by movable mass with relatively higher inertia than the swash plate type) because the oil amount range handled is small in die cushion pressure control in the present invention. The bidirectional variable swash-plate-(angle)-type axial piston pump is used in this embodiment, and a linear motor (not shown) is used to drive the swash plate angle with high response in both (+/−) directions. It is also possible to adopt a general mode to change the swash plate angle by driving the hydraulic cylinder communicating with the swash plate angle using a servo valve or a proportional valve based on a discharge pressure (self-pressure) of the swash plate (angle) type axial piston pump or a separately provided pilot pressure.

Figure 8:
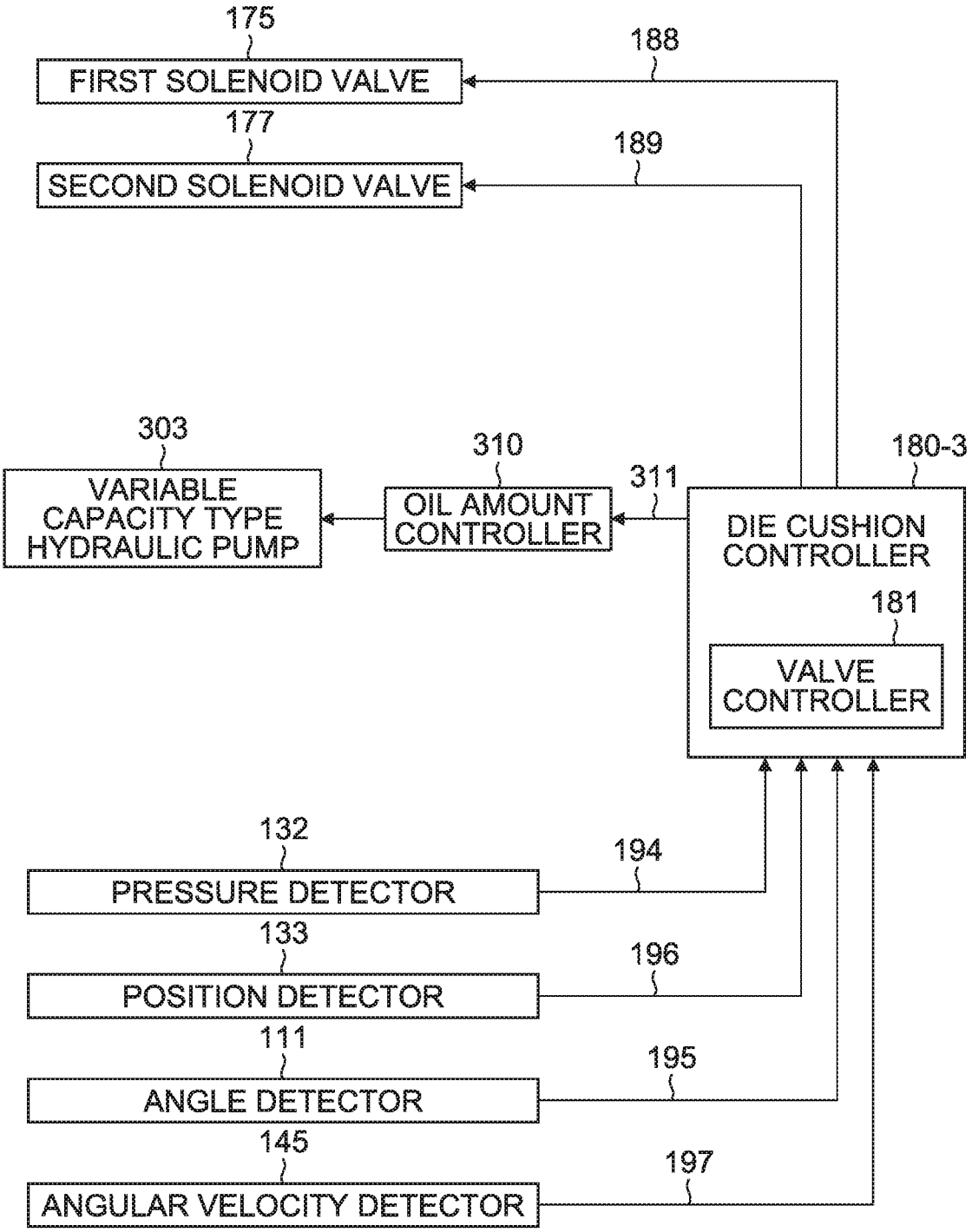
FIG. 8 is a block diagram illustrating a die cushion controller which controls a die cushion apparatus constituting the press system shown in FIG. 7 and an input/output unit thereof.

FIG. 8 is a block diagram illustrating a die cushion controller 180-3 which controls a die cushion apparatus 160-3 constituting the press system 13 shown in FIG. 7 and an input/output unit thereof. Note that in FIG. 8, parts common to the parts of the die cushion controller 180-1 shown in FIG. 3 and an input/output unit thereof are assigned the same reference numerals and detailed description thereof will be omitted.

The die cushion controller 180-3 is different from the die cushion controller 180-1 in that the die cushion controller 180-3 outputs an oil amount command 311 for controlling the variable capacity type hydraulic pump 303 instead of outputting the torque command 190 for controlling torque of the servo motor 151.

In a die cushion force operation step (carrying out a main operation) which is one of the features of the present application, the die cushion controller 180-3 outputs the oil amount command 311 to the variable capacity type hydraulic pump 303 via an oil amount controller 310 based on mainly the die cushion pressure command signal and the die cushion pressure signal detected by the pressure detector 132. Thereby, the die cushion controller 180-3 controls a displacement volume (displacement oil amount) of the variable capacity type hydraulic pump 303 so that the die cushion pressure signal 194 matches the die cushion pressure command signal.

In a steady state except when a die cushion force operation starts, the variable capacity type hydraulic pump 303 performs the functions of: supplementing an oil amount leaked to the low-pressure side via a case of the variable capacity type hydraulic pump 303; supplementing an oil amount leaked to the low-pressure side via the pilot port from the b port of the opened first logic valve 171; supplying a slight oil amount in a case where the pressure is changed (increased) in the direction in which the die cushion force is increased; and discharging a slight oil amount in a case where the pressure is changed (decreased) in the direction in which the die cushion force is decreased. The variable capacity type hydraulic pump 303 has a feature that the oil leakage amount (case drain) is in proportion to the discharge pressure (in the direction from the pressure generation chamber 130*b* toward the system pressure line) in the vicinity where the displacement volume (oil amount) is "0". The feature of the variable capacity type hydraulic pump 303 effectively works in order to control the slight oil amount.

The variable capacity type hydraulic pump 303 is suitable for pressure control because the pressure is likely to change (increase or decrease) in response to a change in the displacement volume in the vicinity of the "0" point with respect to a substantially constant (compressed) volume. To further utilize this characteristic, it is preferable to control the swash plate angle of the variable capacity type hydraulic pump 303 with high accuracy using a linear motor. Displacement volume control responsiveness of the variable capacity type hydraulic pump 303 is not a little inferior to torque (current) control responsiveness of the servo motor 151 or opening control responsiveness of the servo valve 201 even by improving a swash plate angle drive method. However, since the oil amount handled (processed) by the variable capacity type hydraulic pump 303 is small in the die cushion pressure control step of the present invention, the variable capacity type hydraulic pump 303 is by no means inferior than driving using the servo motor 151 or the servo valve 201.

Fifth Embodiment of Press System

Figure 9:
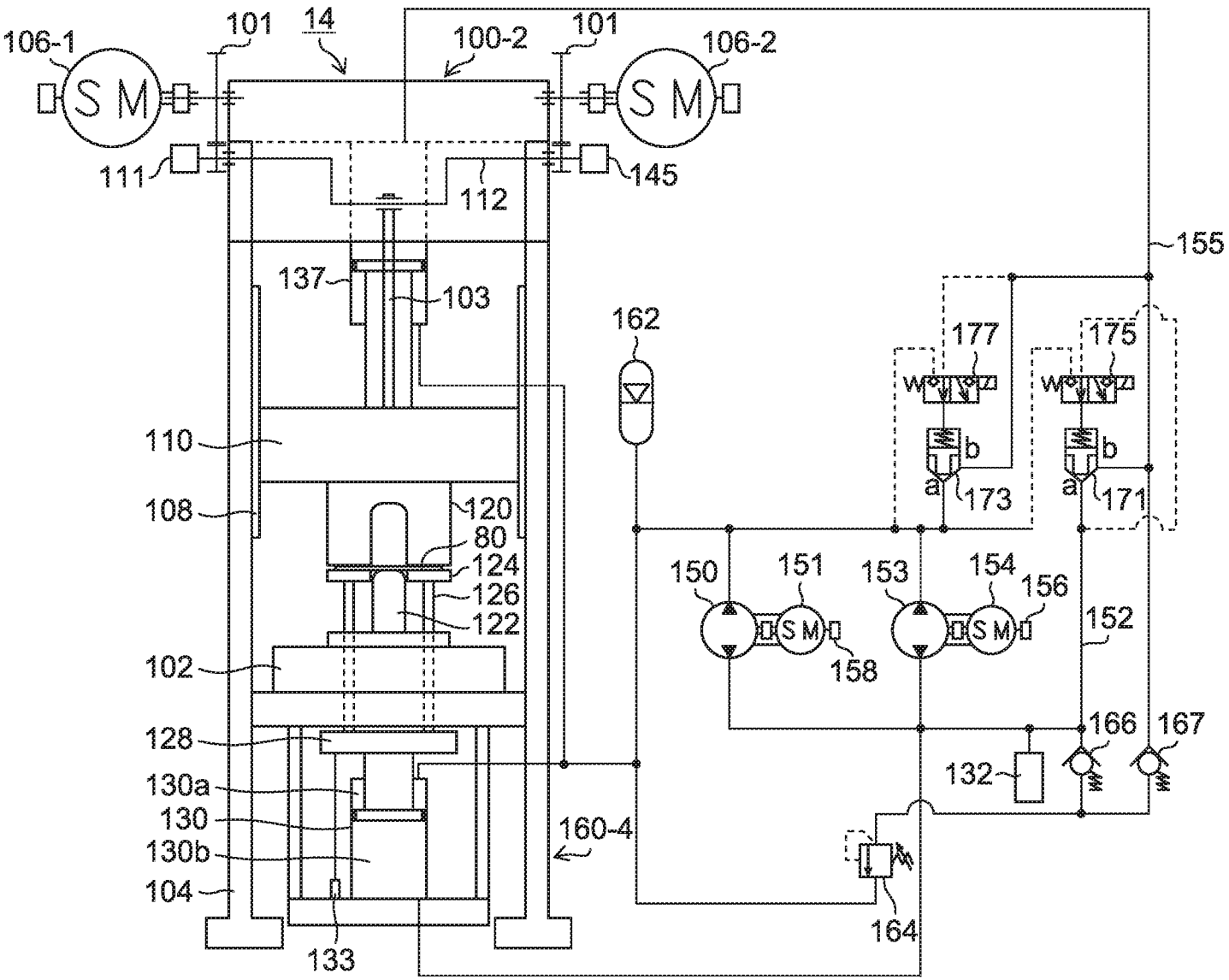
FIG. 9 is a brief configuration diagram illustrating a fifth embodiment of the press system according to the present invention.

FIG. 9 is a brief configuration diagram illustrating a fifth embodiment of the press system according to the present invention.

A press system 14 shown in FIG. 9 is different from the press system 11 shown in FIG. 2 in that a die cushion apparatus 160-4 of the press system 14 includes a plurality of (two) servo motors 151 and 154 (two hydraulic pumps/motors 150 and 153) as opposed to the die cushion apparatus 160-1 of the press system 11 which includes one servo motor 151 (one hydraulic pump motor 150). Note that in FIG. 9, parts common to those in the press system 11 are assigned the same reference numerals and detailed description thereof will be omitted.

Because the press system 11 uses one servo motor 151 having a servo motor capacity of M1, there is a possibility that, as the die cushion force increases (the pressure receiving area of the pressure generation chamber 130*b* of the die-cushion-drive hydraulic cylinder 130 and the pressure receiving area of the pressure generation chamber 137*b* of the slide-drive hydraulic cylinder 137 increase), a pressure buildup time needed to obtain a pressure corresponding to the die cushion load may become longer. In addition, in a case where the cushion pad 128 singly performs a knockout operation, there is a possibility that the knockout speed may decrease.

The press system 14 shown in FIG. 9 solves the problem of delay in the pressure buildup time for the die cushion pressure and the problem of decrease in the knockout speed by providing a plurality of (two) servo motors 151 and 154 (two hydraulic pumps/motors 150 and 153) in parallel.

Here, because the capacity M1 of the die-cushion-drive servo motor 151 is, for example, ¼ of the capacity M4 of the slide-drive servo motor 106-1, a large-capacity servo motor may be used instead of increasing the number of servo motors. For example, in the case of this embodiment, one servo motor having a capacity M2 may be used instead of the two servo motors 151 and 154 respectively having the capacity M1. In a case where a commercially available servo motor having a maximum capacity is still not enough to provide the capacity required by the system, it is preferable to use a plurality of servo motors in parallel.

Sixth Embodiment of Press System

Figure 10:
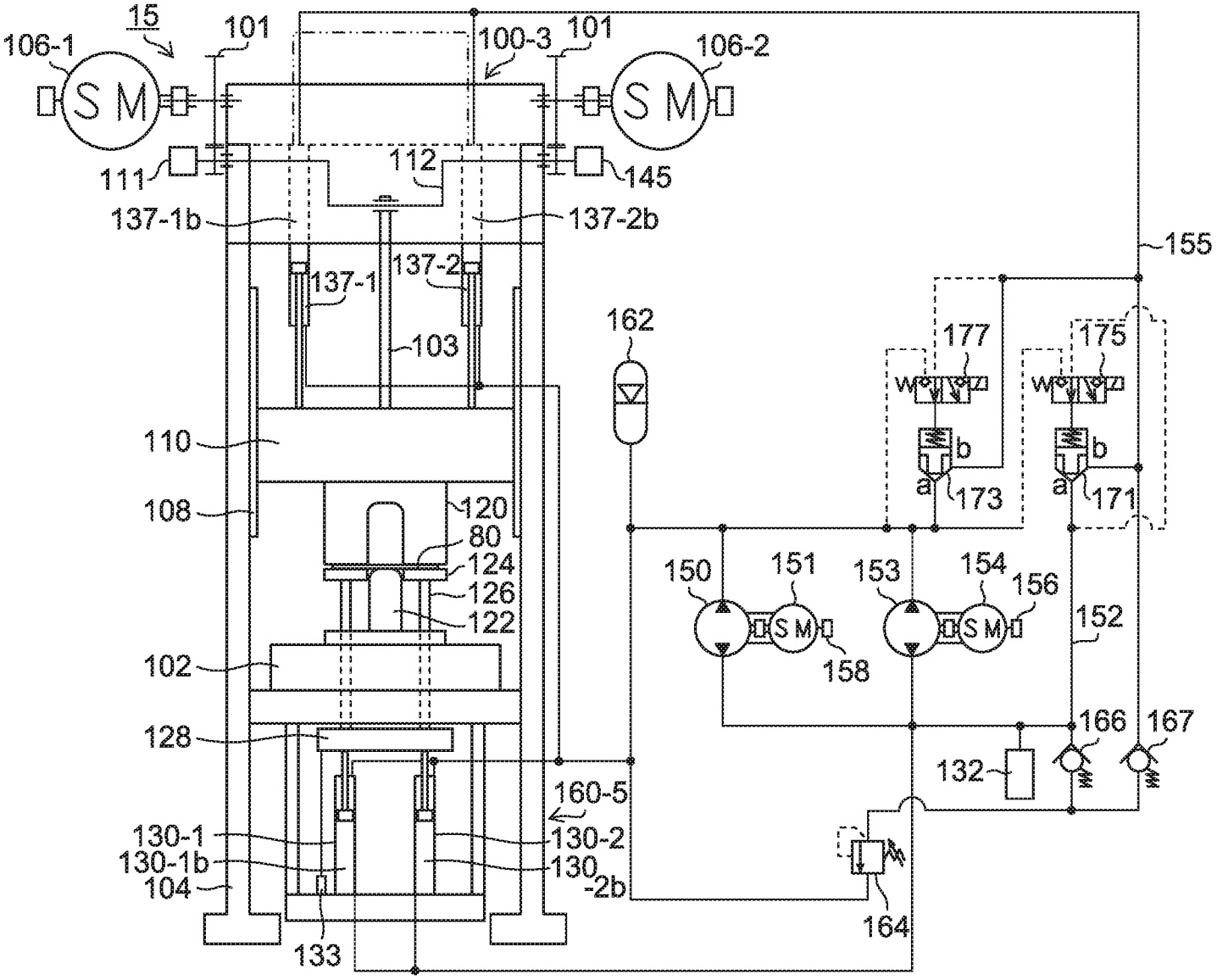
FIG. 10 is a brief configuration diagram illustrating a sixth embodiment of the press system according to the present invention.

FIG. 10 is a brief configuration diagram illustrating a sixth embodiment of the press system according to the present invention.

A press system 15 shown in FIG. 10 has a die cushion apparatus different from the die cushion apparatus in the press system 14 shown in FIG. 9. That is, the die cushion apparatus 160-4 of the press system 14 is provided with one die-cushion-drive hydraulic cylinder 130 and one slide-drive hydraulic cylinder 137, whereas the die cushion apparatus 160-5 of the press system 15 is provided with (a plurality of) two die-cushion-drive hydraulic cylinders 130-1 and 130-2 and two slide-drive hydraulic cylinders 137-1 and 137-2.

The two die-cushion-drive hydraulic cylinders 130-1 and 130-2 shown in FIG. 10 are arranged in parallel at symmetric positions with respect to the cushion pad 128. The pressure generation chambers 130-1*b* and 130-2*b* of the hydraulic cylinders 130-1 and 130-2 communicate with each other, and the rod-side hydraulic chambers of the hydraulic cylinders 130-1 and 130-2 communicate with each other.

Here, if the sum total ($\Sigma S1$) of pressure receiving areas of the pressure generation chambers 130-1*b* and 130-2*b* of the two hydraulic cylinders 130-1 and 130-2 is equal to a pressure receiving area S1 of the pressure generation chamber 130*b* of the one hydraulic cylinder 130, the two hydraulic cylinders 130-1 and 130-2 can be controlled in the same way as the one hydraulic cylinder 130.

Similarly, the two slide-drive hydraulic cylinders 137-1 and 137-2 are arranged in parallel at symmetric positions with respect to the slide 110. Furthermore, the pressure generation chambers 137-1*b* and 137-2*b* of the hydraulic cylinders 137-1 and 137-2 communicate with each other, and the rod-side hydraulic chambers of the hydraulic cylinders 137-1 and 137-2 communicate with each other.

Here, the sum total ($\Sigma S2$) of the pressure receiving areas of the pressure generation chambers 137-1*b* and 137-2*b* of the two hydraulic cylinders 137-1 and 137-2 is configured to match the sum total ($\Sigma S1$) of the pressure receiving areas of the pressure generation chambers 130-1*b* and 130-2*b* of the two hydraulic cylinders 130-1 and 130-2, or satisfy a range of $0.95\times\Sigma S1\leq\Sigma S2\leq1.05\times\Sigma S1$.

With the plurality of die-cushion-drive hydraulic cylinders provided in parallel in this way, it is possible to apply the die cushion load to the cushion pad 128 uniformly.

Furthermore, with the plurality of slide-drive hydraulic cylinders provided in parallel, it is possible to arrange the plurality of slide-drive hydraulic cylinders at positions corresponding to the plurality of die-cushion-drive hydraulic cylinders, or arrange the plurality of hydraulic cylinders in a dispersed arrangement in accordance with the convenience in terms of the arrangement so as not to interfere with other mechanisms (e.g., connecting rod).

Figure 11:
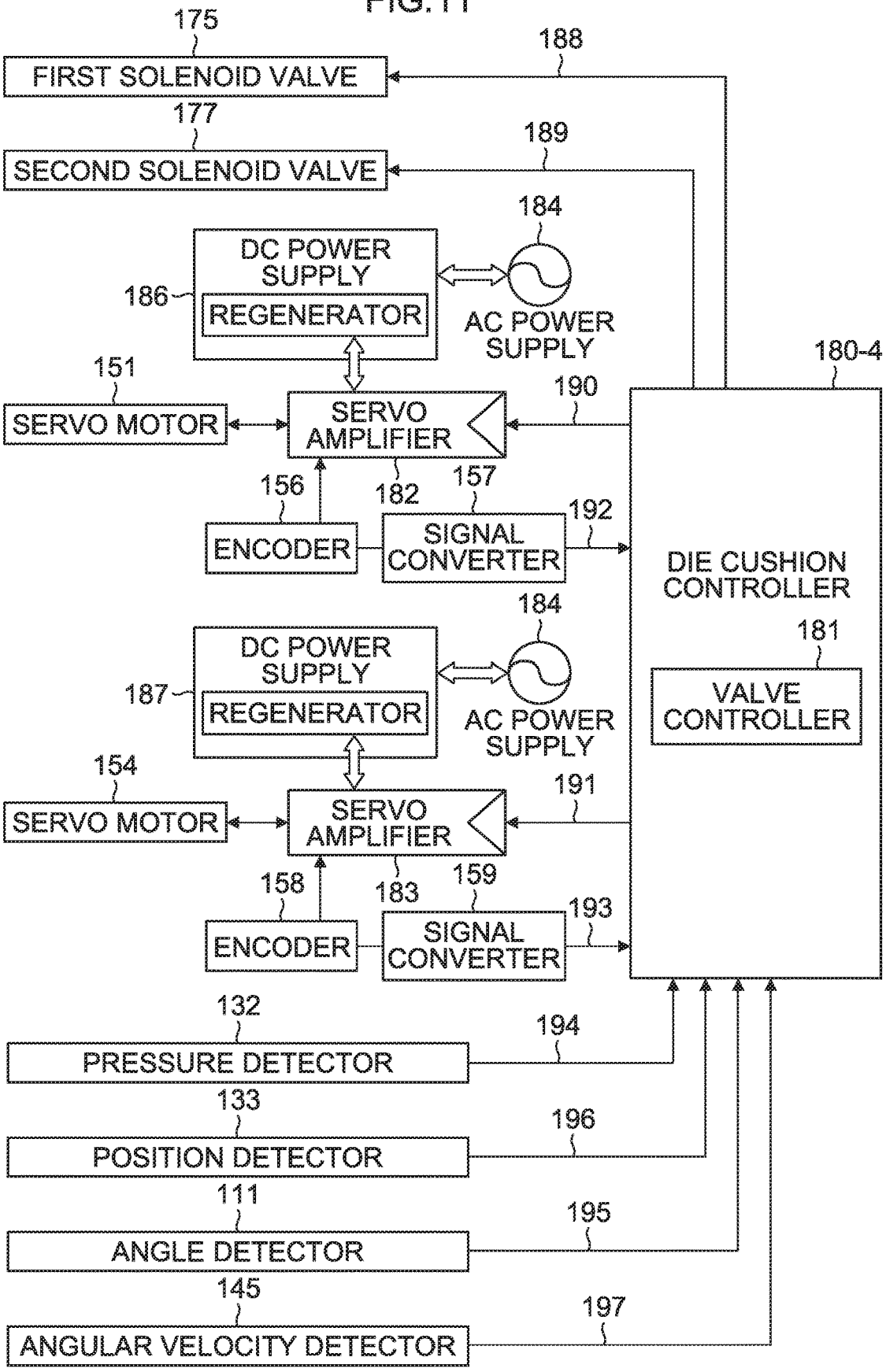
FIG. 11 is a block diagram illustrating a die cushion controller which controls a die cushion apparatus constituting the press system shown in FIG. 9 or FIG. 10 and an input/output unit thereof.

FIG. 11 is a block diagram illustrating a die cushion controller 180-4 which controls the die cushion apparatus 160-4 of the press system 14 shown in FIG. 9 or the die cushion apparatus 160-5 of the press system 15 shown in FIG. 10, and an input/output unit thereof.

The die cushion controller 180-4 shown in FIG. 11 is different from the die cushion controller 180-1 shown in FIG. 3 in that torques of the two servo motors 151 and 154 are independently controlled.

The die cushion controller 180-4 switches between a pressure control state in which a die cushion pressure (die cushion load) applied to the cushion pad 128 by the hydraulic cylinder 130 (or the hydraulic cylinders 130-1 and 130-2) is controlled and a position control state in which the position of the cushion pad 128 is controlled by the hydraulic cylinder 130 (or the hydraulic cylinders 130-1 and 130-2). Further, the die cushion controller 180-4 calculates the torque commands 190 and 191 in the respective control states, and outputs the calculated torque commands 190 and 191 to the servo motors 151 and 154 via servo amplifiers 182 and 183 to control the torques of the servo motors 151 and 154.

The die cushion controller 180-4 receives motor angular velocity signals 192 and 193 generated from encoders 156 and 158 which detect rotations of the servo motors 151 and 154 via signal converters 157 and 159 as angular velocity feedback signals to secure dynamic stability of the die cushion pressure. Furthermore, in the die cushion pressure control state, in a case where the hydraulic pumps/motors 150 and 153 operate as hydraulic motors and the servo motor 151 operates as a power generator, the power generated by the servo motors 151 and 154 is regenerated to an AC power supply 184 from the servo amplifiers 182 and 183 via DC power supplies 186 and 187 having respective power regenerators.

Seventh Embodiment of Press System

Figure 12:
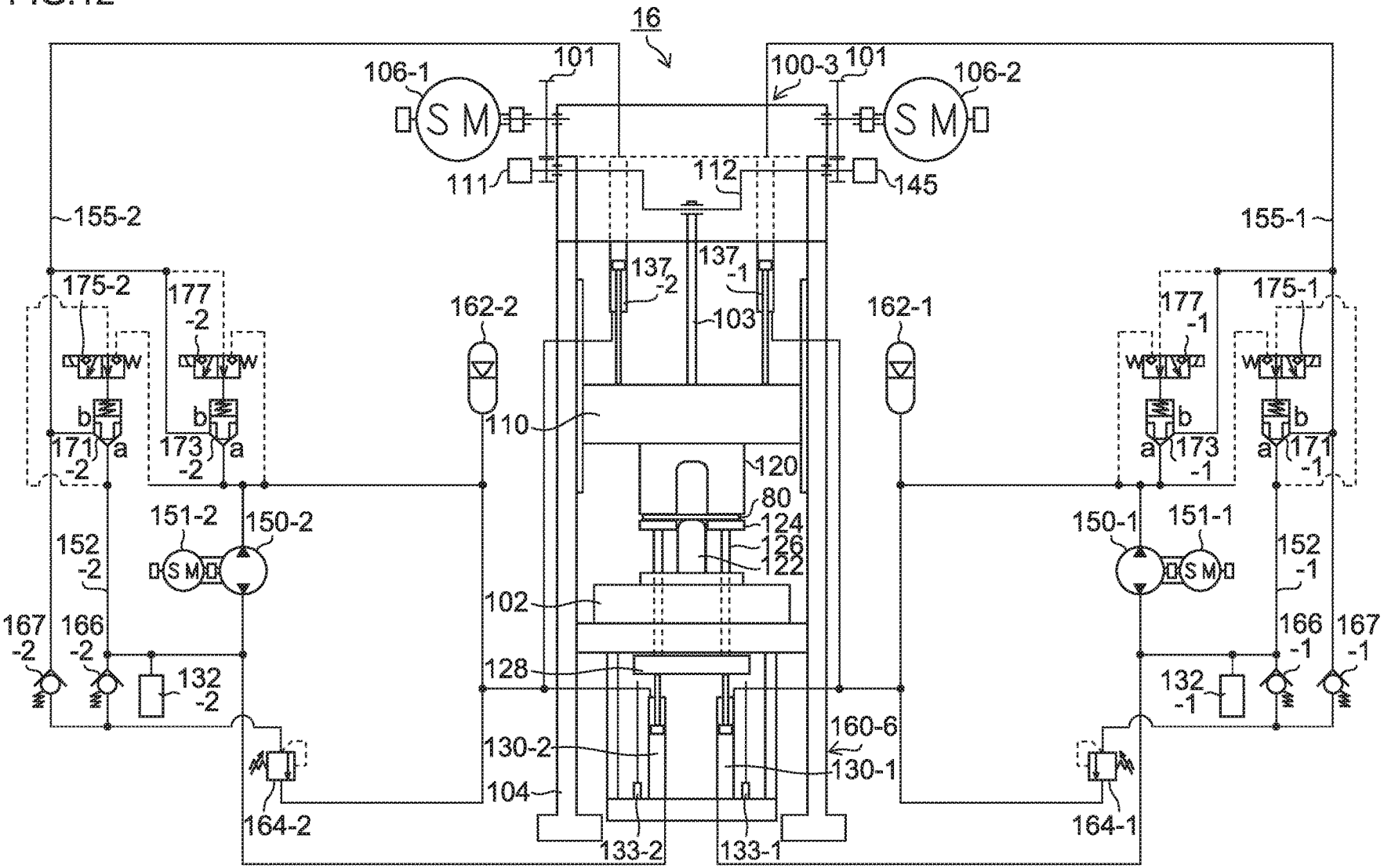
FIG. 12 is a brief configuration diagram illustrating a seventh embodiment of the press system according to the present invention.

FIG. 12 is a brief configuration diagram illustrating a seventh embodiment of the press system according to the present invention.

The press system 16 shown in FIG. 12 has a die cushion apparatus different from the die cushion apparatus of the press system 15 shown in FIG. 10. That is, in the die cushion apparatus 160-5 of the press system 15, the pressure generation chambers of the two die-cushion-drive hydraulic cylinders 130-1 and 130-2 communicate with each other, the rod-side hydraulic chambers of the hydraulic cylinders 130-1 and 130-2 also communicate with each other, and the pressure generation chambers 137*b* of the two slide-drive hydraulic cylinders 137-1 and 137-2 communicate with each other. However, in a die cushion apparatus 160-6 of the press system 16 shown in FIG. 12, the two sets of the die-cushion-drive hydraulic cylinder 130-1 and the slide-drive hydraulic cylinder 137-1, and the hydraulic cylinder 130-2 and the hydraulic cylinder 137-2 have separate hydraulic circuits, so as to be controlled independently of each other.

The hydraulic circuit corresponding to the one set of the hydraulic cylinder 130-1 and the hydraulic cylinder 137-1 (the hydraulic circuit includes a hydraulic pump/motor 150-1 driven by the servo motor 151-1, pipes 152-1 and 155-1, a first logic valve 171-1, a second logic valve 173-1, a first solenoid valve 175-1, a second solenoid valve 177-1, an accumulator 162-1, a pressure detector 132-1, a relief valve 164-1, and check valves 166-1 and 167-1) is independent of the hydraulic circuit corresponding to the other set of the hydraulic cylinder 130-2 and the hydraulic cylinder 137-2 (the hydraulic circuit includes a hydraulic pump/motor 150-2 driven by the servo motor 151-2, pipes 152-2 and 155-2, a first logic valve 171-2, a second logic valve 173-2, a first solenoid valve 175-2, a second solenoid valve 177-2, an accumulator 162-2, a pressure detector 132-2, a relief valve 164-2, and check valves 166-2 and 167-2).

Furthermore, a position detector 133-1 which detects the position of the hydraulic cylinder 130-1 and a position detector 133-2 which detects the position of the hydraulic cylinder 130-2 are also provided independently of each other.

In the press system 16 according to the seventh embodiment, the two hydraulic cylinders 130-1 and 130-2 can be controlled independently of each other. The configuration of press system 16 is effective especially in a case where a die cushion (pressure) force is individually operated for each drawing shape.

In a case where the cushion pad 128 ascends or the cushion pad 128 descends singly during the knockout operation or the like, the cushion pad 128 ascends or descends, with the hydraulic cylinders 130-1 and 137-1, and the hydraulic cylinders 130-2 and 137-2 synchronizing with one another. This ascending or descending of the cushion pad 128 is performed in accordance with a first torque command and a second torque command outputted to the servo motors 151-1 and 151-2 via the respective servo amplifiers. The first torque command and the second torque command are calculated from one die cushion position command (G), a position detection signal (H1) detected from the position detector 133-1 which detects the position of the hydraulic cylinder 130-1, a position detection signal (H2) detected from the position detector 133-2 which detects the position of the hydraulic cylinder 130-2 and motor angular velocity signals (I1) and (I2) (corresponding to the motor angular velocity signals 192 and 193 in FIG. 11) of the respective servo motors 151-1 and 151-2. Specifically, the first torque command is calculated from G, H1 and I1, and the second torque command is calculated from G, H2 and I2.

Eighth Embodiment of Press System

Figure 13:
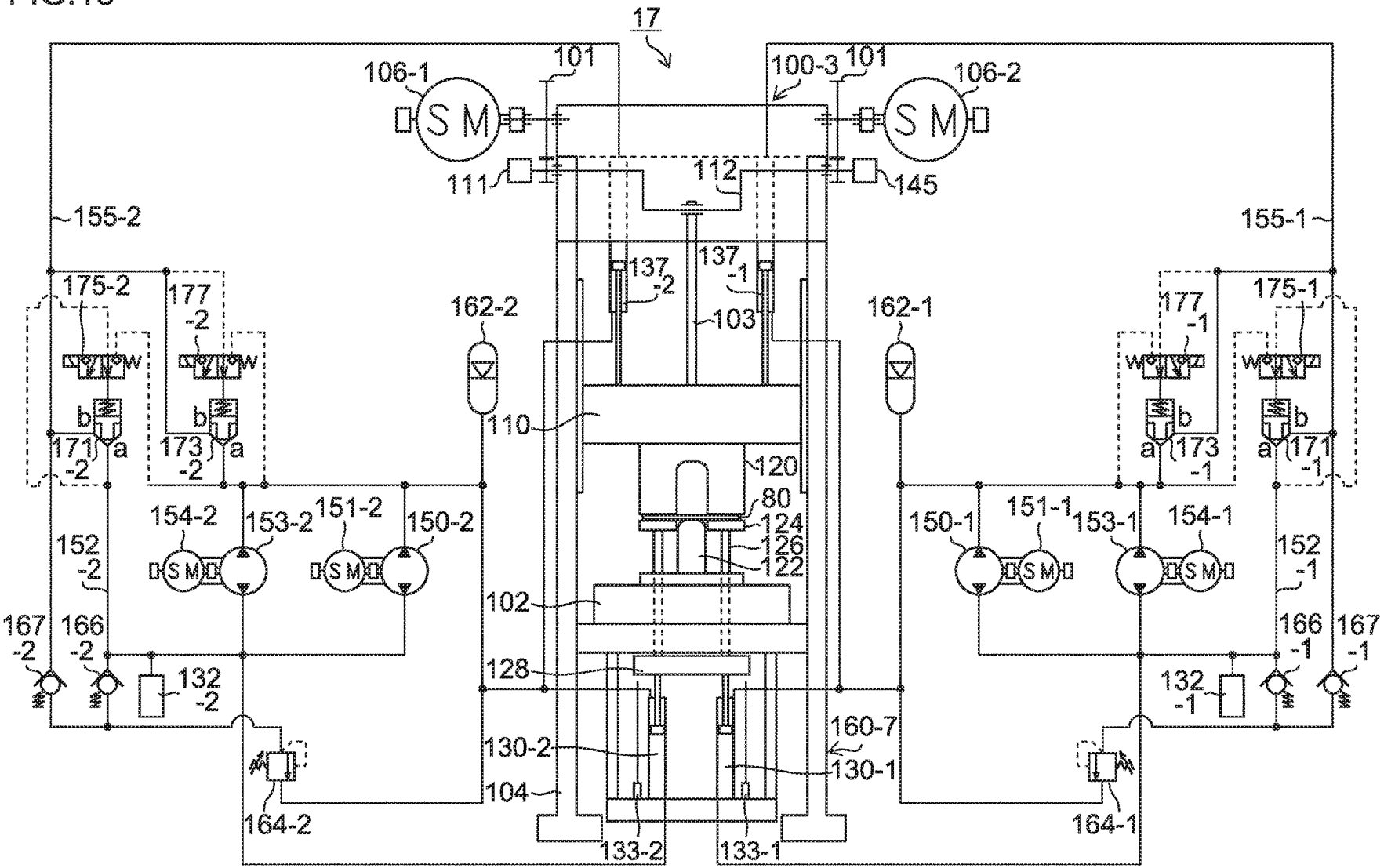
FIG. 13 is a brief configuration diagram illustrating an eighth embodiment of the press system according to the present invention.

FIG. 13 is a brief configuration diagram illustrating an eighth embodiment of the press system according to the present invention.

A press system 17 shown in FIG. 13 has a die cushion apparatus different from the die cushion apparatus of the press system 16 shown in FIG. 12. Specifically, in the die cushion apparatus 160-6 of the press system 16, the hydraulic circuit corresponding to the one set of the hydraulic cylinder 130-1 and the hydraulic cylinder 137-1 and the hydraulic circuit corresponding to the other set of the hydraulic cylinder 130-2 and the hydraulic cylinder 137-2 respectively include one servo motor 151-1, 151-2 (and hydraulic pump/motor 150-1, 150-2 shaft-connected to the servo motor 151-1, 151-2), whereas the die cushion apparatus 160-7 of the press system 17 includes a plurality of (two) servo motors 151-1, 154-1, 151-2, 154-2 (and the hydraulic pumps/motors 150-1, 153-1, 150-2, 153-2 shaft-connected to the servo motors 151-1, 154-1, 151-2, 154-2) provided for each hydraulic circuit. Note that in FIG. 13, parts common to the parts of the press system 16 are assigned the same reference numerals and detailed description thereof will be omitted.

The press system 16 uses one servo motor 151-1 or 151-2 having a servo motor capacity of M1 for each independently controlled hydraulic circuit. Therefore, the press system 16 may have the problem that a pressure buildup time needed to obtain a pressure corresponding to the die cushion load becomes longer as the die cushion force increases, and the problem that the knockout speed is deceased in a case where the cushion pad 128 singly performs a knockout operation.

Because the press system 17 shown in FIG. 13 includes a plurality of (two) servo motors 151-1, 154-1, 151-2, 154-2 (two hydraulic pumps/motors 150-1, 153-1, 150-2, 153-2) which are provided in parallel for each independently controlled hydraulic circuit, the problem of delay in pressure buildup time for the die cushion pressure and the problem of slowdown in the knockout speed.

Operation

Next, operation of the press system according to the present invention will be described.

Figure 14:
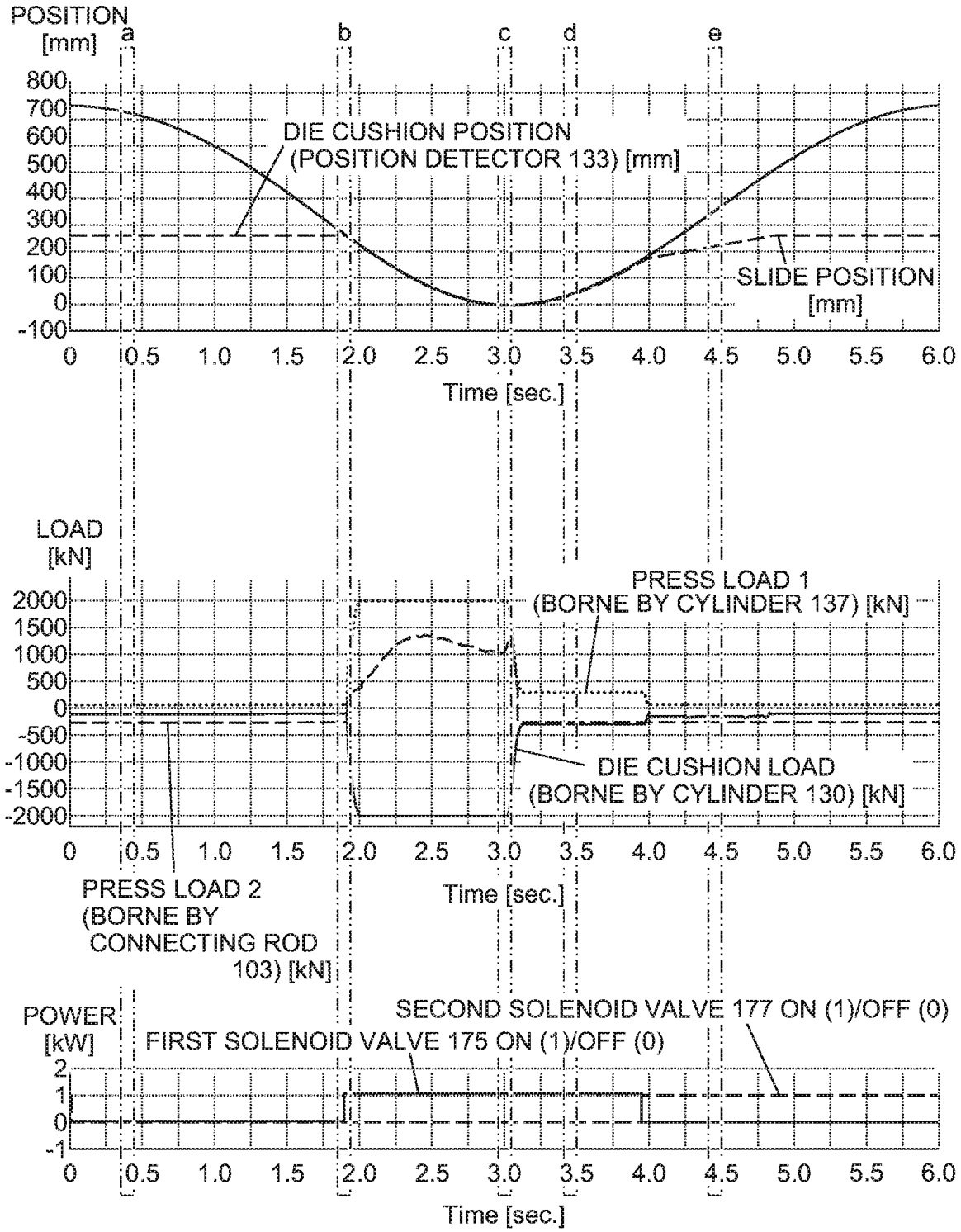
FIG. 14 is a graph illustrating a physical quantity waveform for a one-cycle period of the press system according to the sixth embodiment shown in FIG. 10.

FIG. 14 is a graph illustrating waveforms of physical quantities for one-cycle period of the press system 15 according to the sixth embodiment shown in FIG. 10. FIG.

Figure 19:
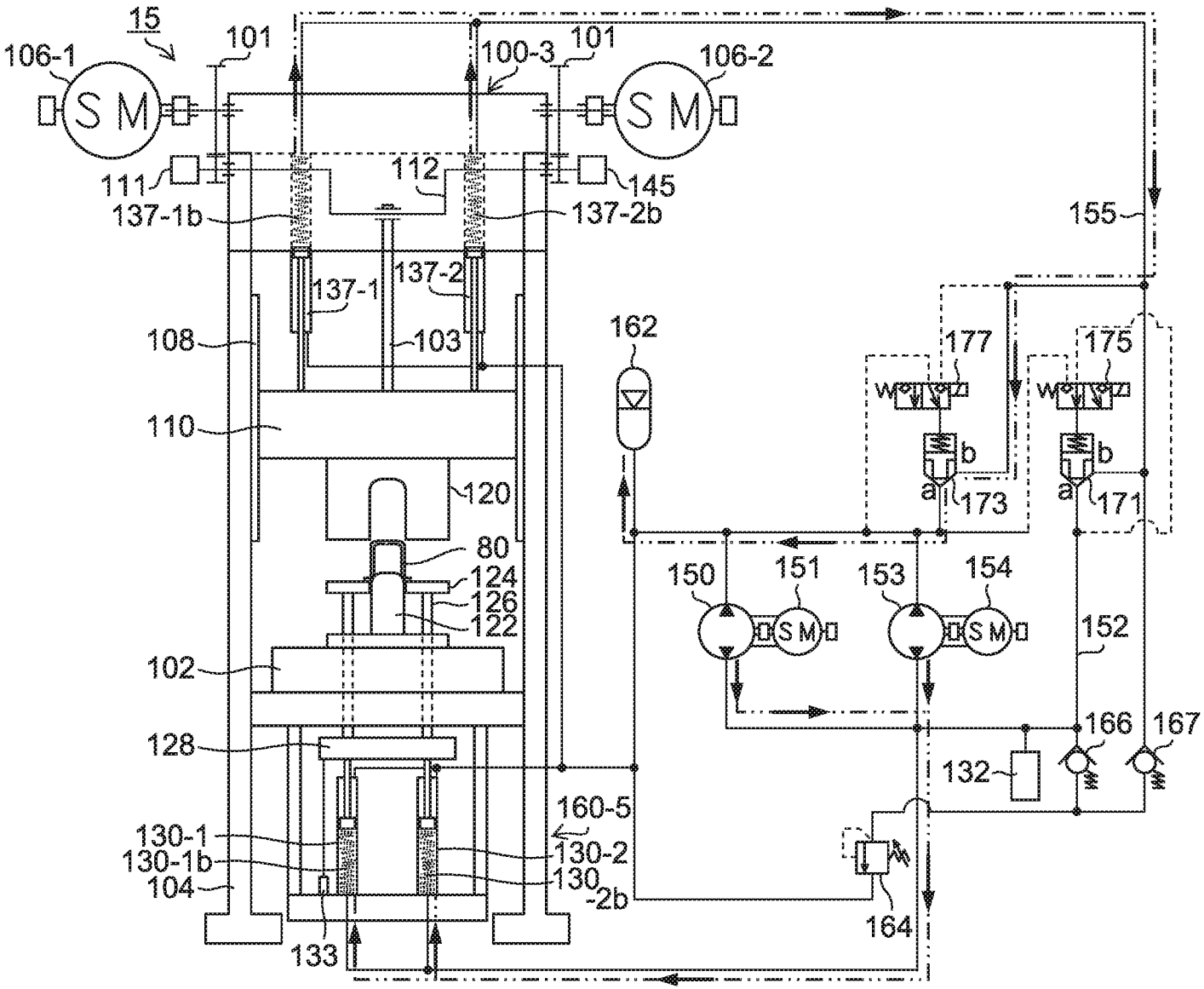
FIG. 19 is a diagram illustrating a state of the press system according to the sixth embodiment when the slide of the press machine is ascending and at a later stage of the knockout operation.

15 to FIG. 19 are diagrams illustrating an operation state of the press system 15 in five processes a to e of one-cycle period of the press system 15 respectively.

An upper part in FIG. 14 shows a die cushion position (die cushion position detected by the position detector 133) (mm) and a position of the slide 110 (slide position). A middle part in FIG. 14 shows a die cushion load (kN) borne by the hydraulic cylinder 130 (130-1, 130-2), a press load (1) (kN) borne by the hydraulic cylinder 137 (137-1, 137-2) and a press load (2) (kN) borne by the connecting rod 103 of the press machine 100-3 assuming that the downward direction is positive. A lower part shows an ON (1)/OFF (0) signal of the first solenoid valve 175 and an ON (1)/OFF (0) signal of the second solenoid valve 177.

<a: "state of press"—slide is descending (before drawing starts), "state of die cushion"—waiting at standby position>

Figure 15:
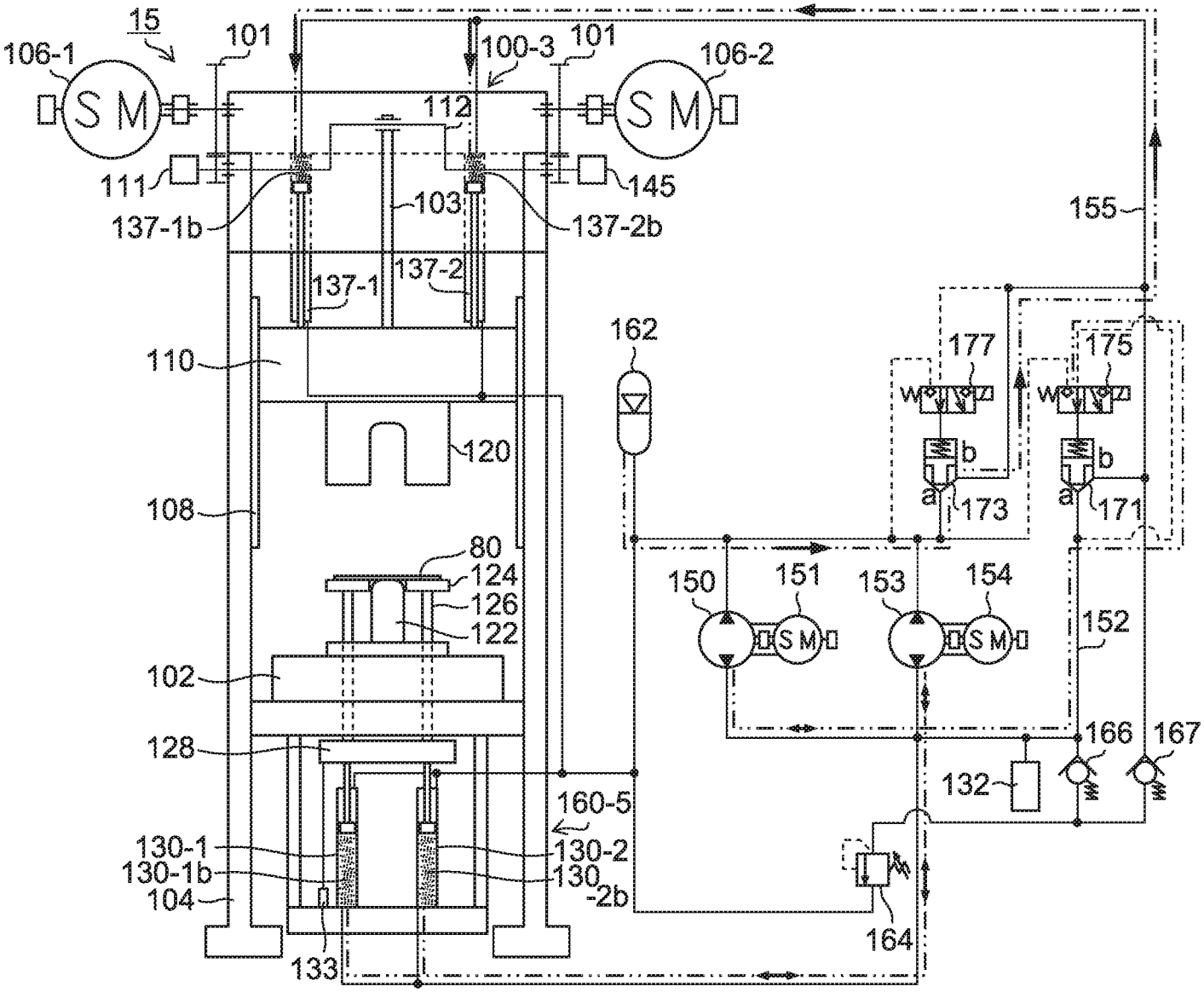
FIG. 15 is a diagram illustrating a state of the press system according to the sixth embodiment in which the slide of the press machine is descending and before drawing starts and while the cushion pad is on standby at a predetermined standby position.

FIG. 15 corresponds to the process a in FIG. 14. FIG. 15 illustrates a state of the press system 15 in which the slide 110 of the press machine 100-3 is descending and before drawing starts, and the cushion pad 128 is waiting at a predetermined standby position.

The crank shaft 112 of the press machine 100-3 is driven via the reduction gear 101 by (both) the servo motors 106-1 and 106-2, based on a crank shaft-angular velocity command signal (not shown), an angle signal detected from the angle detector 111 attached to the crank shaft 112 and angular velocity signals (not shown) of the servo motors 106-1 and 106-2 so that the crank shaft 112 has a predetermined (command-following) angular velocity.

The slide 110 descends via the connecting rod 103 according to the angular velocity of the crank shaft 112. In this process a, drawing has not been started yet.

Furthermore, piston rods of the hydraulic cylinders 137-1 and 137-2 which are disposed so as to cancel the die cushion load are connected to the slide 110. The system pressure (substantially constant low pressure in a range of around 3 to 15 kg/cm$^2$) stored in the accumulator 162 is applied to the pressure generation chambers 137-1*b* and 137-2*b* of the hydraulic cylinders 137-1 and 137-2 via the second logic valve 173 with the second solenoid valve 177 being set in an OFF (0) state. A press load (1) (approximately 50 kN) is applied to the slide 110 from the piston rods of the hydraulic cylinders 137-1 and 137-2 (downward). The press load (1) in this state is not contribute to forming of the material 80.

At this time, a force for accelerating/decelerating the slide 110 downward (slide accelerating/decelerating force), a force supporting the press load (1) (approximately 50 kN) and a force supporting the gravity of the slide 110 (approximately 200 kN) are applied to the connecting rod 103. Since the accelerating/decelerating force is relatively small (so small to be negligible in this embodiment), the press load (2) borne by the connecting rod 103 is approximately −250 kN (upward) which cancels the press load (1) and the gravity of the slide 110.

The cushion pad 128 of the die cushion apparatus 160-5 is driven via the hydraulic cylinders 130-1 and 130-2 so as to be placed at a predetermined standby position. The predetermined standby position is a position where the material 80 on the blank holder 124 supported by the cushion pins 126 disposed on the cushion pad 128 comes into contact with the upper die 120 at a predetermined slide position (slide position when the die cushion load action starts).

The die cushion controller 180-4 (FIG. 11) calculates the torque commands 190 and 191 based on a standby position command signal (not shown), the die cushion position signal 196 and the motor angular velocity signals 192 and 193, and controls torques of the servo motors 151 and 154 based on the calculated torque commands 190 and 191 respectively. The hydraulic pumps/motors 150 and 153 driven by the torque-controlled servo motors 151 and 154 supply hydraulic oil to the hydraulic cylinders 130-1 and 130-2, and the position of the cushion pad 128 is controlled so that the cushion pad waits at a predetermined standby position.

At this time, the die cushion load (on CYL 130) acting on the piston rods of the hydraulic cylinders 130-1 and 130-2 substantially corresponds to the gravity of the cushion pad 128 and is approximately −100 kN (upward).

The first solenoid valve 175 controlled by the valve controller 181 is in an OFF (0) state. The pressures of the pressure generation chambers 130-1*b* and 130-2*b* of the hydraulic cylinders 130-1 and 130-2 are applied to the a port ("a" port) and the pilot port of the first logic valve 171. The pressures of the pressure generation chambers 137-1*b* and 137-2*b* of the hydraulic cylinders 137-1 and 137-2, which are smaller than the pressures applied to the a port, are applied to the b port of the first logic valve 171. At this time, the first logic valve 171 is closed. Therefore, the powers of the servo motors 151 and 154 are used only for driving the hydraulic cylinders 130-1 and 130-2.

Moreover, the second solenoid valve 177 is in an OFF (0) state. The system pressure is applied to the a port of the second logic valve 173, and the pressures acting on the pressure generation chambers of the hydraulic cylinders 137-1 and 137-2, are applied to the b port and the pilot port of the second logic valve 173. Here, the pressures acting on the pressure generation chambers of the hydraulic cylinders 137-1 and 137-2 fall below the system pressure due to the slide descending operation. At this time, the second logic valve 173 is open. Therefore, the pressure slightly lower than the system pressure acts on the respective pressure generation chambers of the hydraulic cylinders 137-1 and 137-2 such that no negative pressure is produced (pressure is likely to rise when forming starts) during a period when the press forming is not working (before drawing starts) while the slide is descending.

<b: press—slide is descending and drawing starts, die cushion—die cushion load control starts>

Figure 16:
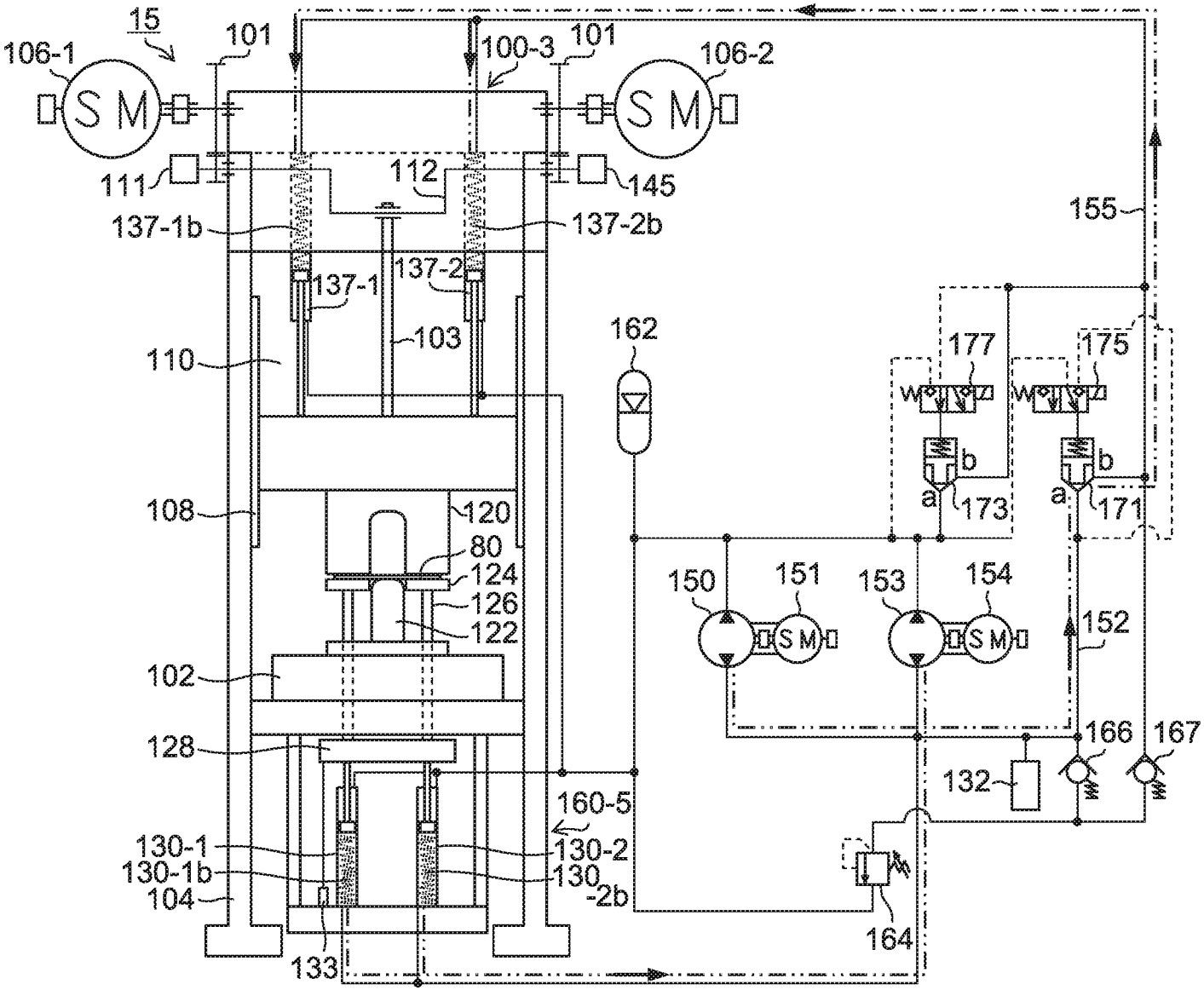
FIG. 16 is a diagram illustrating a state of the press system according to the sixth embodiment when the slide of the press machine is descending, drawing starts, an upper die, a blank holder and a lower die come into contact (collision) with one another via a material, and the cushion pad starts die cushion load control.

FIG. 16 which corresponds to the process b in FIG. 14. FIG. 16 shows a state of the press system 15 when the slide 110 of the press machine 100-3 is descending, and the upper die 120, the blank holder 124 and the lower die 122 come into contact (collision) with one another via the material 80 to start drawing, and the cushion pad 128 starts die cushion load control.

The timing when the die cushion load control starts is a timing when a slide position calculated (converted) based on the crank angle signal 195 reaches a preset die cushion standby position.

The die cushion controller 180-4 (FIG. 11) calculates the torque commands 190 and 191 of the servo motors 151 and 154 based on the die cushion pressure command signal (not shown), the die cushion pressure signal 194, the motor angular velocity signals 192 and 193, and a slide speed signal calculated (converted) from the crank angular velocity signal 197. The die cushion controller 180-4 controls the torque of the servo motors 151 and 154 based on the calculated torque commands 190 and 191 so that a predetermined (set) die cushion load (2000 kN) is generated in the piston rods of the hydraulic cylinders 130-1 and 130-2. The respective hydraulic pumps/motors 150 and 153 shaft-connected to the servo motors 151 and 154 whose torques are controlled. Thus, the pressures acting on the respective pressure generation chambers of the hydraulic cylinders 130-1 and 130-2 which are respectively connected to one side (high-pressure side) ports of the hydraulic pumps/motors 150 and 153, can be controlled to become a predetermined value ($P_H$) (matching the command).

Here, the motor angular velocity signals 192 and 193 of the servo motors 151-1 and 154 are used to improve (advance) pressure phase delay characteristics in pressure control by the die cushion controller 180-4 and secure dynamic stability. The slide speed signal converted from the crank angular velocity signal 197 is used for control compensation to improve pressure accuracy in the pressure control when there is a difference in pressure receiving areas between the respective pressure generation chambers of the hydraulic cylinders 130-1, 130-2 and the hydraulic cylinders 137-1, 137-2.

The valve controller 181 of the die cushion controller 180-4 turns ON (1) the first solenoid valve 175 simultaneously with the starting of the die cushion load control so that the system pressure is applied to the pilot port of the first logic valve 171, thereby opening the first logic valve 171. At this time, the pressure ($P_H$) applied to (or in process of to be applied to) the pressure generation chambers of the hydraulic cylinders 130-1 and 130-2 is also applied to the pressure generation chambers of the slide-drive hydraulic cylinders 137-1 and 137-2 via the opened first logic valve 171. Furthermore, the second logic valve 173 is closed since the pressure $P_H$ is applied to the pilot port of the second logic valve 173.

Because the pressure generation chambers of the die cushion load generation hydraulic cylinders 130-1 and 130-2 communicate with the pressure generation chambers of hydraulic cylinders 137-1 and 137-2 for generating the press load (1), the pressure $P_H$ acts on the respective cylinders. The pressure oil displaced (pushed away) from the pressure generation chambers of the hydraulic cylinders 130-1 and 130-2 is supplied to the pressure generation chambers of the hydraulic cylinders 137-1 and 137-2 as the slide descends. After all, since the total amount of pressure oil intervening between the pressure generation chambers 130-1*b* and 130-2*b* of the hydraulic cylinders 130-1 and 130-2 and the pressure generation chambers 137-1*b* and 137-2*b* of the hydraulic cylinders 137-1 and 137-2 is unchanged, the servo motors 151 and 154 which control the pressure $P_H$ basically do not rotate (work) but are required to rotate (work) only minutely so as to compensate the loss caused by leakage from the hydraulic pumps/motors 150 and 153.

<b to c: "state of press"—drawing in progress, "state of die cushion"—die cushion load control in progress>

Figure 17:
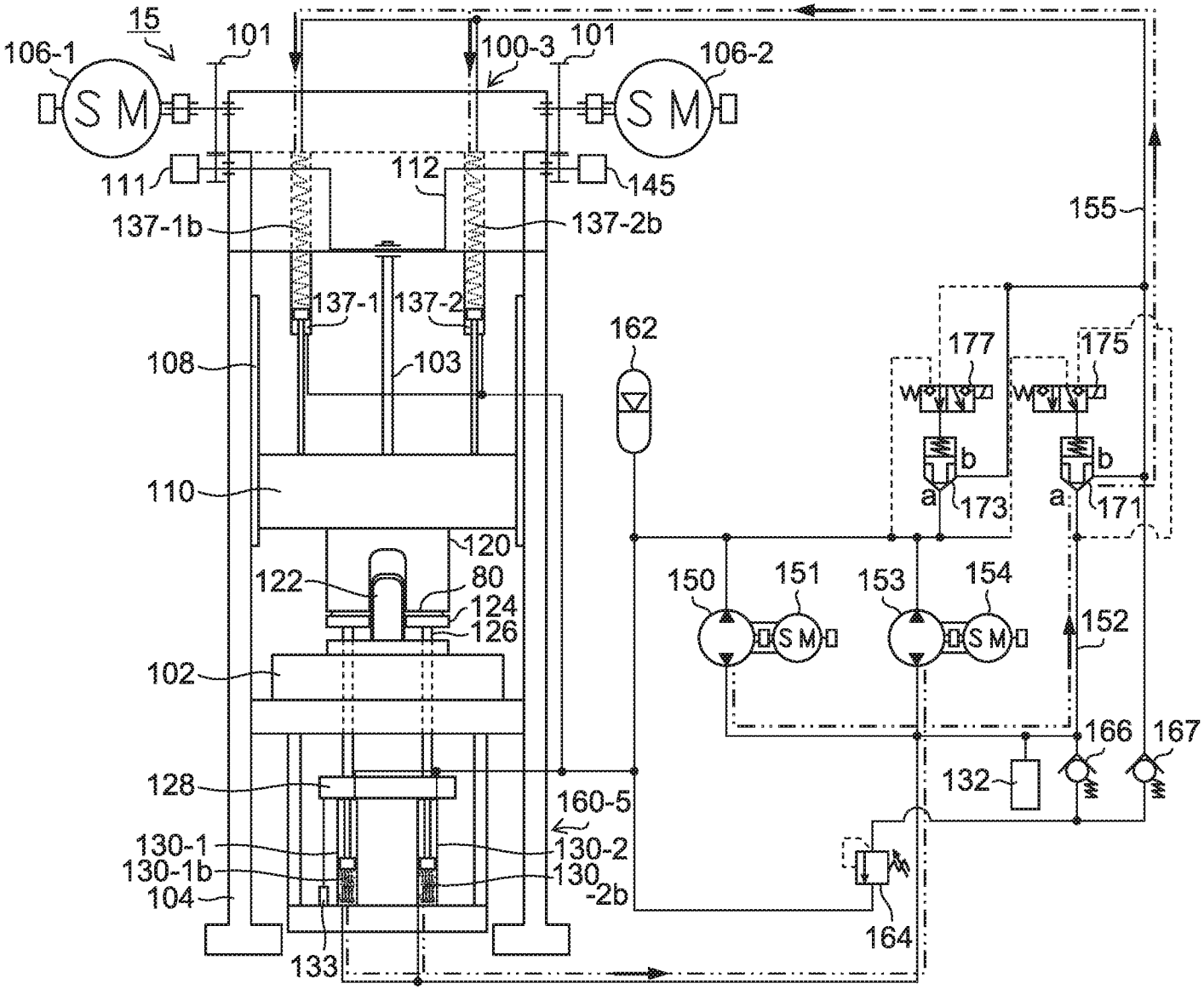
FIG. 17 is a diagram illustrating a state of the press system according to the sixth embodiment when the slide of the press machine reaches a bottom dead center, drawing ends and die cushion load control ends.

Drawing is performed from the state shown in FIG. 16 corresponding to the process b in FIG. 14 till the state shown in FIG. 17 corresponding to the process c in FIG. 14.

The middle part in FIG. 14 shows a state in which the die cushion load and the press load (1) are acting so as to cancel each other all the time during forming, and a state in which the press load (2) is applied to the connecting rod 103.

The press load (2) represents a drawing load generated in the process in which a contour portion of the material 80 is pressed by the die cushion load against the upper die 120 and the blank holder 124 and a central portion of the material 80 is subjected to drawing while being sandwiched between the upper die 120 and the lower die 122. The press load (2) gently increases from time when the drawing starts and reaches a maximum value of 1350 kN substantially at the middle of the forming stroke (die cushion stroke) (having a length of 260 mm).

After all, in the process in which drawing is performed, no work relating to the die cushion load action (except for the loss) is performed and only the work relating to a net drawing load action is performed by the servo motors 106-1 and 106-2 via the reduction gear 101, the crank shaft 112, the connecting rod 103 and the slide 110.

<c: "state of press"—reaching slide's bottom dead center and end of drawing, "state of die cushion"—end of die cushion load control>

FIG. 17 corresponds to the process c in FIG. 14. FIG. 17 illustrates a state of the press system 15 when the slide 110 of the press machine 100-3 reaches the bottom dead center, drawing ends and die cushion load control ends.

The timing at which the slide 110 of the press machine 100-3 reaches the bottom dead center is a timing at which the slide position converted from the crank angle signal 195 indicates 0 (zero) or a timing at which the slide position reaches a predetermined slide position slightly ahead of the timing when the slide position indicates 0.

While keeping the pressure control state started from the point in time b shown in FIG. 14, a die cushion pressure command signal (not shown) is changed so that 300 kN (programmed in advance) for an initial stage of knockout is generated at the piston rods of the hydraulic cylinders 130-1 and 130-2 and the piston rods of the hydraulic cylinders 137-1 and 137-2. After all, the pressures applied to the pressure generation chambers 130-1*b* and 130-2*b* of the hydraulic cylinders 130-1 and 130-2 and the pressures applied to the pressure generation chamber 137-1*b* and 137-2*b* of the hydraulic cylinders 137-1 and 137-2 communicating therewith are decompressed from the pressure $P_H$ corresponding to the predetermined die cushion load to a pressure $P_L$ corresponding to the load 300 kN for an initial stage of knockout.

The initial knockout force which is made to act by this pressure $P_L$ is a minimum necessary value excelling the gravity acting on the cushion pad 128, the cushion pin 126, the blank holder 124 and the product or the frictional force generated along with sliding between the product and the lower die 122, which is necessary for the slide 110 to ascend while the upper die 120 and the blank holder 124 are stably keeping the contact state via the contour portion (unnecessary portion of the product) of the product (which is the formed material 80).

<d: "state of press"—slide is ascending, "state of die cushion"—initial stage of knockout>

Figure 18:
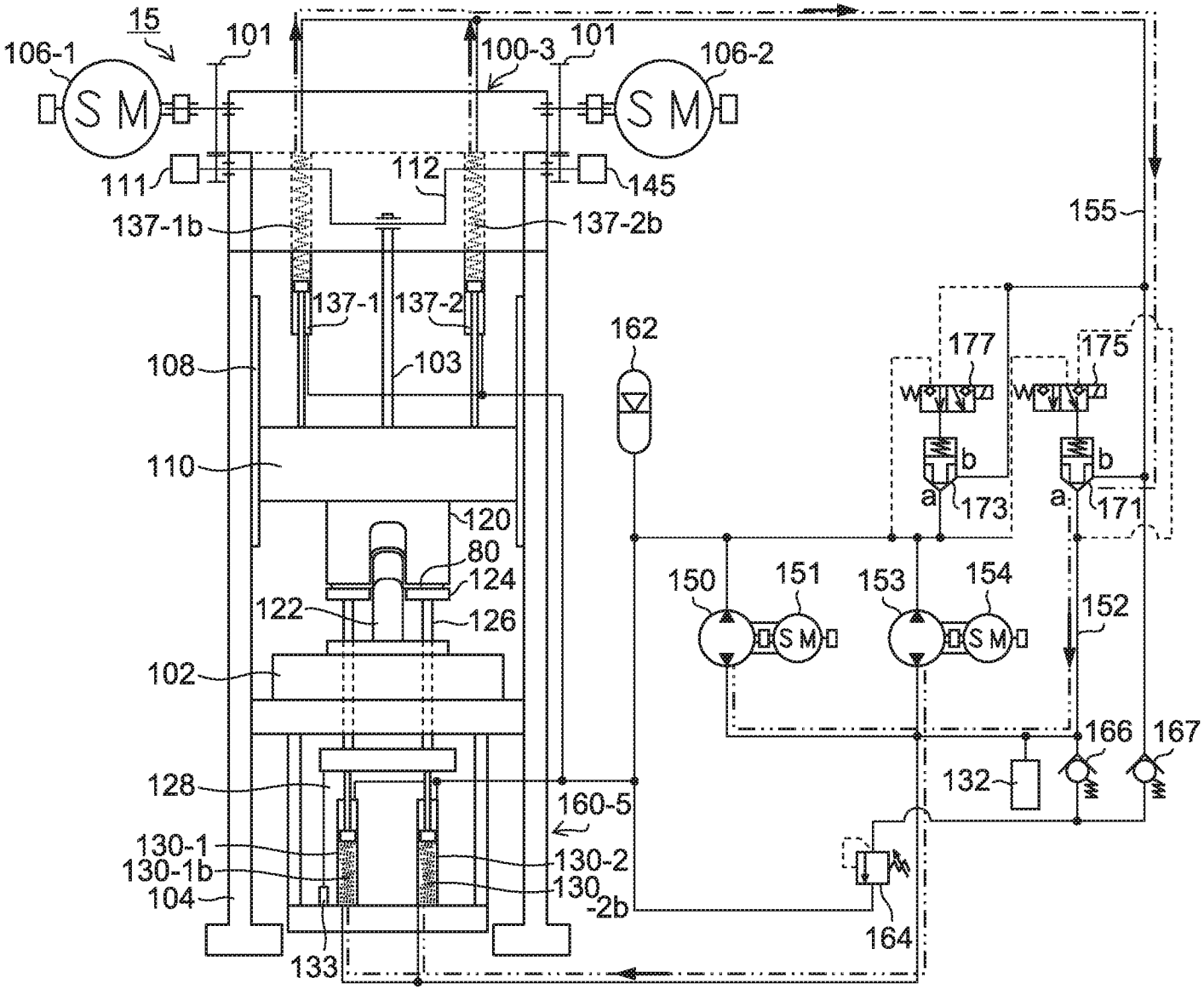
FIG. 18 is a diagram illustrating a state of the press system according to the sixth embodiment when the slide of the press machine starts to ascend from the bottom dead center and at an initial stage of knockout when a knockout operation starts.

FIG. 18 corresponding to the process d in FIG. 14 shows a state of the press system 15 in an initial stage of knockout when the slide 110 of the press machine 100-3 starts ascending from the bottom dead center and the knockout operation starts.

In the initial stage of knockout, the product is knocked out as the slide 110 ascends with the upper die 120 and the blank holder 124 are keeping the contact state via the contour portion of the product through action of initial knockout (programmed in advance) 300 kN on the piston rods of the hydraulic cylinders 130-1 and 130-2, and the piston rods of the hydraulic cylinders 137-1 and 137-2.

At this time, the pressure oil displaced from the pressure generation chambers 137-1*b* and 137-2*b* of the hydraulic cylinders 137-1 and 137-2 is supplied to the pressure generation chambers 130-1*b* and 130-2*b* of the hydraulic cylinders 130-1 and 130-2. The servo motors 151 and 154 which control the knockout (controls the pressure $P_L$) basically do not (is not required to) rotate (work) (except for the loss) in this way, providing excellent efficiency.

<e: "state of press"—slide is ascending, "state of die cushion"—later stage of knockout>

FIG. 19 corresponding to the process e in FIG. 14 shows a state of the press system 15 while the slide 110 of the press machine 100-3 is ascending and in a late stage of knockout operation.

During the knockout operation of the cushion pad 128, when the slide reaches a point 160 mm ahead of a standby position (slide position 260 mm when die cushion load action starts), the valve controller 181 causes the first solenoid valve 175 to turn OFF (0), and causes the second solenoid valve 177 to turn ON (1) to thereby close the first logic valve 171 and open the second logic valve 173.

The die cushion controller 180-4 operates the torque commands 190 and 191 based on a position command signal moving (sweeping) from the position control start position (approximately 175 mm before the first logic valve 171 is closed) toward the standby position, the die cushion position signal 196, motor angular velocity signals 192 and 193 and a slide position signal converted from the crank angle signal 195 and controls torque of the servo motors 151 and 154 based on the calculated torque commands 190 and 191 respectively. The hydraulic pumps/motors 150 and 153 driven by the torque-controlled servo motors 151 and 154 supply hydraulic oil to the hydraulic cylinders 130-1 and 130-2, and the cushion pad 128 is position-controlled so as to ascend at a predetermined (set) speed and stop at a standby position.

Furthermore, the pressure oil displaced from the hydraulic cylinders 137-1 and 137-2 is absorbed into the accumulator 162 via the second logic valve 173.

As shown in the waveform diagram in the upper part in FIG. 14 (relationship between the die cushion position and the slide position), in the later knockout, the cushion pad 128 knocks out the product via the cushion pin 126, the blank holder 124 and the contour portion of the product without contacting the upper die 120.

The motor angular velocity signals 192 and 193 of the servo motors 151-1 and 154 are used to improve (advance) the position phase delay characteristic in position control and secure dynamic stability and the slide position signal converted from the crank angle signal 195 is used to prevent the cushion pad 128 from colliding (interfering) with the slide 110.

COMPARATIVE EXAMPLES

FIG. 20 is a table illustrating a motor capacity, average power during forming and a power supply capacity of the whole press system according to the present invention and prior arts 1 to 3.

Figure 22:
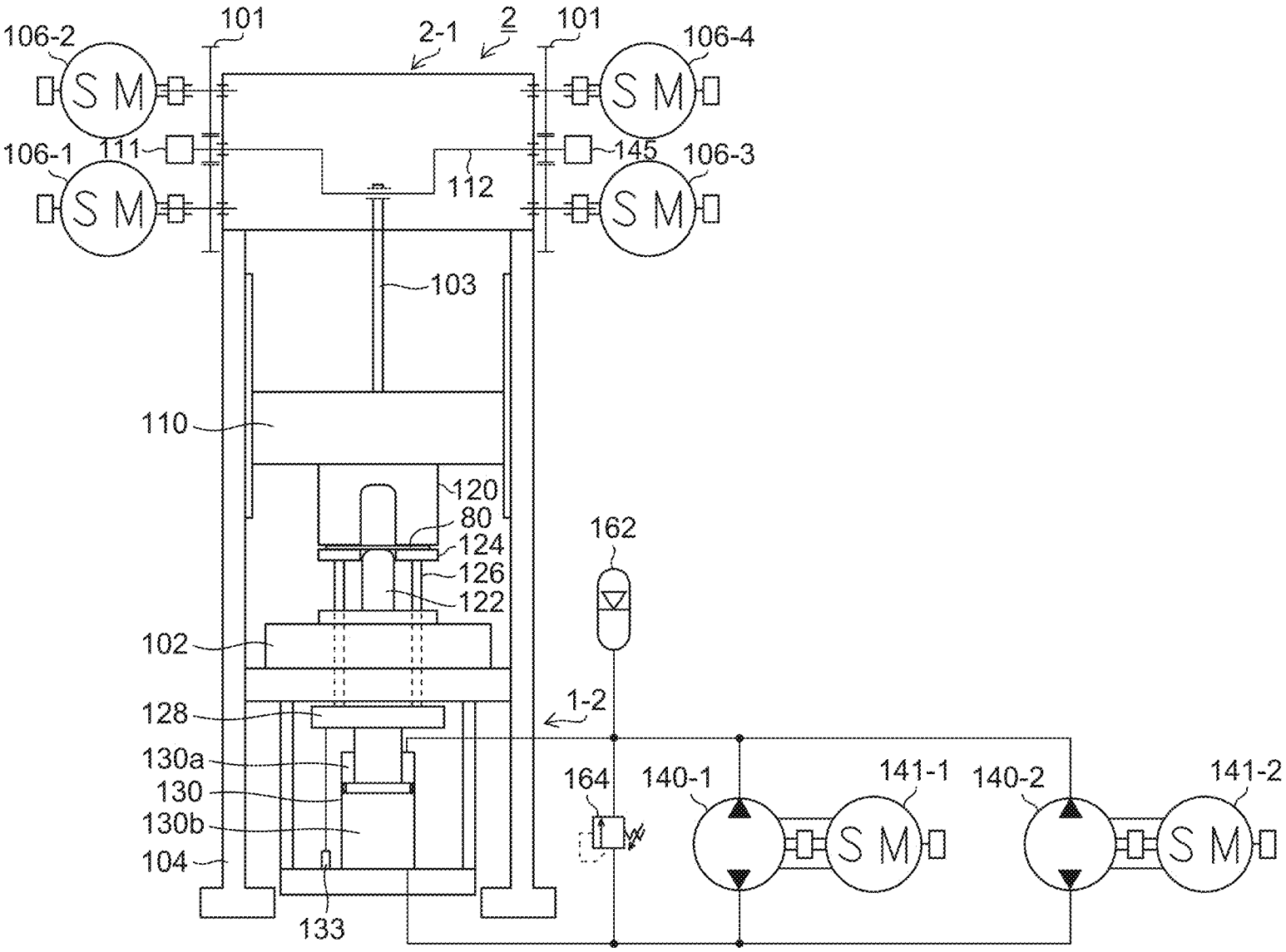
FIG.22 Prior Art
FIG. 22 is a diagram illustrating another example of a press system driven by a conventional servo motor.

The present invention corresponds to, for example, the press system 10 of the first embodiment shown in FIG. 1, the prior art 1 corresponds to the conventional press systems shown in FIG. 21 and FIG. 22, the prior art 2 corresponds to the press system described in Japanese Patent Application Laid-Open No. 2010-069498 and the prior art 3 corresponds to the conventional press system including the die cushion apparatus described in WO2010-058710.

In the case of the prior art 1, when power necessary for net forming (power required by the whole press system with respect to the outside) is assumed to be 1, the required servo motor capacities and the driver capacities (motor capacity) which are proportional to the power are: 2 for the press machine; 1 for the die cushion apparatus; and 3 for the whole press system.

A power supply apparatus is necessary to provide average power (average power during forming) consumed by the whole press system for forming of 1.3 and a power supply capacity of 3.

In the case of the prior art 2, the required motor capacities of the servo motors are: 2 for the press machine; 1 for the die cushion apparatus; and 3 for the whole press system. A power supply apparatus is necessary to provide average power during forming of 1.15 and a power supply capacity of 1.15. In the prior art 1, the value 1.15 of the average power during forming is regenerated to the power supply via a regenerative converter, whereas the prior art 2 takes into consideration the efficiency improvement which eliminates the necessity for power regeneration in a configuration including a shared DC power supply.

In the case of the prior art 3, the required motor capacities of the servo motors are: 2 for the press machine; 0.5 for the die cushion apparatus; and 2.5 for the whole press system. A power supply apparatus is necessary to provide average power during forming of 1.65 and a power supply capacity of 2.5.

In contrast, in the case of the present invention, the required motor capacities of the servo motors are: 1 for the press machine; 0.2 for the die cushion apparatus; and 1.2 for the whole press system. Furthermore, a power supply apparatus is necessary to provide average power during forming of 1.1 and a power supply capacity of 1.2 (the power supply capacity of 1.2 is a value when the prior art 2 is not applied).

As is also apparent from FIG. 20, the servo motor capacity of the whole press system in the present invention is drastically reduced compared to the prior arts 1 to 3. For example, the present invention can reduce the motor capacity by 60% compared to the prior arts 1 and 2, and can also reduce the motor capacity by around 50% compared to the prior art 2. Furthermore, it is known that the present invention also excels the prior art 1 to 3 in terms of average power during forming.

The power supply capacity is a value to which the prior art 2 is not applied, but is comparable to the prior art 2, the gist of the invention of which is a reduction of power supply capacity.

Others

The number of die-cushion-drive hydraulic cylinders and the number of slide-drive hydraulic cylinders are not limited to one or two in the respective embodiments, and the number of die-cushion-drive hydraulic cylinders and the number of slide-drive hydraulic cylinders can be different as long as their pressure receiving areas are substantially equal.

Although a crank press including a crank shaft and a connecting rod has been described in the embodiments as a press machine in a mechanical drive mode, but without being limited to this, the present invention is also applicable to press machines in other mechanical drive modes such as a link motion press, screw press or cam press.

Furthermore, oil is used as a hydraulic liquid for the die-cushion-drive hydraulic cylinders and the slide-drive hydraulic cylinders, but the hydraulic liquid is not limited to oil, and it goes without saying that hydraulic cylinders using water or other liquids can be used in the present invention.

Furthermore, the present invention is not limited to the above-described embodiments, but it goes without saying that the present invention can be modified in various ways without departing from the spirit and scope of the present invention.

What is claimed is:

1. A press system comprising:

a die cushion apparatus; and a press machine, wherein the die cushion apparatus comprises a first hydraulic cylinder configured to support a cushion pad and apply a die cushion load to the cushion pad when a slide of the press machine descends, the press machine comprises a second hydraulic cylinder configured to apply a part of a press load to the slide when the slide descends, and the press system comprises:

a piping configured to connect between a first pressure generation chamber which is provided to the first hydraulic cylinder and configured to generate the die cushion load, and a second pressure generation chamber which is provided to the second hydraulic cylinder and configured to generate the part of the press load;

a pilot-drive-type first logic valve configured to allow the piping to establish communication between the first pressure generation chamber and the second pressure generation chamber for a period during which the die cushion load acts on the first hydraulic cylinder;

a first solenoid valve configured to switch a pressure acting on a pilot port of the first logic valve between a pressure of the first pressure generation chamber of the first hydraulic cylinder and a system pressure which is a pressure of a low-pressure source; and a valve controller configured to switch the first solenoid valve at least for the period during which the die cushion load acts on the first hydraulic cylinder, and cause the pressure of the low-pressure source to act on the pilot port of the first logic valve to open the first logic valve, the press system further comprises:

a pilot-drive-type second logic valve configured to block or establish communication between the second pressure generation chamber of the second hydraulic cylinder and the low-pressure source; and a second solenoid valve configured to switch a pressure acting on a pilot port of the second logic valve between a pressure of the second pressure generation chamber of the second hydraulic cylinder and the system pressure which is the pressure of the low-pressure source, and for a period before the die cushion load acts on at least the first hydraulic cylinder and the slide descends, the valve controller switches the second solenoid valve and causes the pressure of the second pressure generation chamber to act on the pilot port of the second logic valve to open the second logic valve, and switches the first solenoid valve and causes the pressure of the first pressure generation chamber to act on the pilot port of the first logic valve to close the first logic valve.

2. The press system according to claim 1, wherein when a pressure receiving area of the first pressure generation chamber of the first hydraulic cylinder is S1 and a pressure receiving area of the second pressure generation chamber of the second hydraulic cylinder is S2, the S2 is preferably 0.95×S1 or more and 1.05×S1 or less.

3. The press system according to claim 1, wherein the press machine comprises a third hydraulic cylinder configured to generate a residual press load on the slide when the slide descends, the residual press load being a remaining part of the press load excluding the part of the press load.

4. The press system according to claim 3, wherein the press machine comprises a plurality of the third hydraulic cylinders, and the plurality of third hydraulic cylinders are provided in parallel to the slide.

5. The press system according to claim 1, wherein the press machine comprises a mechanical drive unit configured to mechanically apply a residual press load to the slide when the slide descends, the residual press load being a remaining part of the press load excluding the part of the press load.

6. The press system according to claim 5, wherein the mechanical drive unit comprises:

a crank shaft;

a connecting rod configured to connect the crank shaft and the slide; and a crank shaft drive unit configured to drive the crank shaft.

7. The press system according to claim 1, wherein the die cushion apparatus comprises a plurality of the first hydraulic cylinders, the plurality of first hydraulic cylinders are provided in parallel, and the first pressure generation chambers of the plurality of first hydraulic cylinders are caused to communicate with each other.

8. The press system according to claim 1, wherein the press machine comprises a plurality of the second hydraulic cylinders, the plurality of second hydraulic cylinders are provided in parallel, and the second pressure generation chambers of the plurality of second hydraulic cylinders are caused to communicate with each other.

9. The press system according to claim 1, wherein in a knockout operation period of a product press-formed by the press machine, the valve controller switches the first solenoid valve, causes the pressure of the first pressure generation chamber higher than the system pressure to act on the pilot port of the first logic valve to close the first logic valve, switches the second solenoid valve, and causes the system pressure to act on the pilot port of the second logic valve to open the second logic valve.

10. The press system according to claim 1, wherein the die cushion apparatus comprises:

a pressure detector configured to detect a pressure of the first pressure generation chamber of the first hydraulic cylinder;

a pressure adjustment mechanism configured to adjust the pressure of the first pressure generation chamber of the first hydraulic cylinder; and a die cushion controller configured to control the pressure adjustment mechanism based on a die cushion pressure command corresponding to a predetermined die cushion load and the pressure detected by the pressure detector such that the pressure of the first pressure generation chamber becomes the pressure corresponding to the die cushion pressure command, and the pressure adjustment mechanism comprises:

a hydraulic pump/motor provided in parallel to the valve, and including a discharge port which is connected to the first pressure generation chamber of the first hydraulic cylinder; and a servo motor connected to a rotary shaft of the hydraulic pump/motor, and the die cushion controller controls a torque of the servo motor based on the die cushion pressure command and the pressure detected by the pressure detector such that the pressure of the first pressure generation chamber becomes the pressure corresponding to the die cushion pressure command.

11. The press system according to claim 1, wherein the die cushion apparatus comprises:

a pressure detector configured to detect a pressure of the first pressure generation chamber of the first hydraulic cylinder;

a pressure adjustment mechanism configured to adjust the pressure of the first pressure generation chamber of the first hydraulic cylinder; and a die cushion controller configured to control the pressure adjustment mechanism based on a die cushion pressure command corresponding to a predetermined die cushion load and the pressure detected by the pressure detector such that the pressure of the first pressure generation chamber becomes the pressure corresponding to the die cushion pressure command, and the pressure adjustment mechanism comprises:

a servo valve connected to the first pressure generation chamber of the first hydraulic cylinder and provided in parallel to the valve; and a high-pressure source configured to supply a hydraulic liquid having a substantially constant high pressure equal to or higher than a predetermined die cushion pressure to the servo valve, and the die cushion controller controls an opening of the servo valve based on the die cushion pressure command and the pressure detected by the pressure detector such that the pressure of the first pressure generation chamber becomes the pressure corresponding to the die cushion pressure command.

12. The press system according to claim 1, wherein the die cushion apparatus comprises:

a pressure detector configured to detect a pressure of the first pressure generation chamber of the first hydraulic cylinder;

a pressure adjustment mechanism configured to adjust the pressure of the first pressure generation chamber of the first hydraulic cylinder; and a die cushion controller configured to control the pressure adjustment mechanism based on a die cushion pressure command corresponding to a predetermined die cushion load and the pressure detected by the pressure detector such that the pressure of the first pressure generation chamber becomes the pressure corresponding to the die cushion pressure command, and the pressure adjustment mechanism comprises:

a bidirectional variable capacity type hydraulic pump connected to the first pressure generation chamber of the first hydraulic cylinder and provided in parallel to the valve; and an electric motor connected to a rotary shaft of the bidirectional variable capacity type hydraulic pump, and the die cushion controller controls a volume of a hydraulic liquid pushed away by the bidirectional variable capacity type hydraulic pump based on the die cushion pressure command and the pressure detected by the pressure detector such that the pressure of the first pressure generation chamber becomes the pressure corresponding to the die cushion pressure command.

13. The press system according to claim 1, wherein the first hydraulic cylinder, the second hydraulic cylinder, the piping and the first logic valve are provided in plurality respectively, and the die cushion apparatus comprises:

a plurality of pressure detectors configured to detect pressures of the first pressure generation chambers of the plurality of the first hydraulic cylinders respectively;

a plurality of pressure adjustment mechanisms configured to adjust pressures of the first pressure generation chambers of the plurality of the first hydraulic cylinders respectively; and a die cushion controller configured to control the plurality of pressure adjustment mechanisms respectively based on a die cushion pressure command corresponding to a predetermined die cushion load and the pressures detected by the plurality of pressure detectors such that the pressures of the plurality of the first pressure generation chambers become pressures corresponding to the die cushion pressure command.

* * * * *